US007519302B2

(12) United States Patent
Matsuhara

(10) Patent No.: US 7,519,302 B2
(45) Date of Patent: Apr. 14, 2009

(54) IMAGE PROCESSING SYSTEM AND IMAGE PROCESSING DEVICE CAPABLE OF TRANSFERRING DATA OF JOB BETWEEN IMAGE PROCESSING DEVICE AS WELL AS CONTROL PROGRAM FOR THE SAME

(75) Inventor: Kenji Matsuhara, Kawanishi (JP)

(73) Assignee: Konica Minolta Business Technologies, Inc., Chiyoda-ku, Tokyo (JP)

( * ) Notice: Subject to any disclaimer, the term of this patent is extended or adjusted under 35 U.S.C. 154(b) by 200 days.

(21) Appl. No.: 11/189,978

(22) Filed: Jul. 27, 2005

(65) Prior Publication Data

US 2006/0233563 A1 Oct. 19, 2006

(30) Foreign Application Priority Data

Apr. 13, 2005 (JP) ..... 2005-115992

(51) Int. Cl.
*G03G 15/00* (2006.01)

(52) U.S. Cl. ..... 399/8; 399/80; 358/1.15

(58) Field of Classification Search ..... 399/8, 399/79, 80; 358/1.15; 709/213, 216; 713/168, 713/169, 182, 184
See application file for complete search history.

(56) References Cited

U.S. PATENT DOCUMENTS 5,784,664 A * 7/1998 Nakamura et al. ..... 399/8
5,791,790 A 8/1998 Bender et al.
6,216,113 B1 4/2001 Aikens et al.
6,612,758 B2 9/2003 Yokoyama
7,058,332 B2 * 6/2006 Moroi ..... 399/80
7,119,916 B2 * 10/2006 Kato et al. ..... 358/1.15
7,130,066 B1 * 10/2006 Kanematu ..... 358/1.15
2003/0142348 A1 7/2003 Hiramatsu et al.
2006/0104656 A1 * 5/2006 Tomita et al. ..... 399/80

FOREIGN PATENT DOCUMENTS

JP 2000206835 A * 7/2000
JP 2001-109595 4/2001
JP 2002-189581 7/2002
JP 2002-297332 10/2002
JP 2003-208283 A 7/2003

OTHER PUBLICATIONS

Notice of Grounds of Rejection issued by the Japanese Patent Office in priority Japanese Patent Application No. 2005-115992 on Jan. 9, 2007, and English translation thereof.

* cited by examiner

*Primary Examiner*—Robert Beatty
(74) *Attorney, Agent, or Firm*—Buchanan Ingersoll & Rooney PC

(57) ABSTRACT

An image processing system includes a first image processing apparatus executing a job of processing an image, and a second image processing apparatus connectable to the first image processing apparatus over a network. The second image processing apparatus includes an authentication unit authenticating a user. The first image processing apparatus includes a job storing unit storing the job in a manner linked to information specifying the user, and a job transferring unit transferring to the second image processing apparatus the job linked to the information specifying the user authenticated by the authentication unit in the job storing unit.

12 Claims, 21 Drawing Sheets

FIG.11

| FILE NAME | USER NAME | EXECUTION STATE |
|---|---|---|
| Micro | Tanaka | BEING EXECUTE |
| FILE1 | Nakamura | WAITING FOR EXECUTION |
| PAT | Tanaka | WAITING FOR EXECUTION |

FIG.12

| FILE NAME | USER NAME | EXECUTION STATE |
|---|---|---|
| Micro | Tanaka | BEING EXECUTE |
| FILE1 | Nakamura | WAITING FOR EXECUTION |
| PAT | Tanaka | WAITING FOR EXECUTION |
| Micro | Tanaka | WAITING FOR EXECUTION |

FIG.13

| FILE NAME | USER NAME | EXECUTION STATE |
|---|---|---|
| Micro | Tanaka | BEING EXECUTE |
| FILE1 | Nakamura | WAITING FOR EXECUTION |
| PAT | Tanaka | WAITING FOR EXECUTION |

FIG.17

| FILE NAME | USER NAME | EXECUTION STATE |
|---|---|---|
| — | — | — |

FIG.18

| FILE NAME | USER NAME | EXECUTION STATE |
|---|---|---|
| Micro | Tanaka | WAITING FOR EXECUTION |

IMAGE PROCESSING SYSTEM AND IMAGE PROCESSING DEVICE CAPABLE OF TRANSFERRING DATA OF JOB BETWEEN IMAGE PROCESSING DEVICE AS WELL AS CONTROL PROGRAM FOR THE SAME

This application is based on Japanese Patent Application No. 2005-115992 filed with the Japan Patent Office on Apr. 13, 2005, the entire content of which is hereby incorporated by reference.

BACKGROUND OF THE INVENTION

1. Field of the Invention

The present invention relates to an image processing system and an image processing apparatus, and particularly to an image processing apparatus, which can execute a job of performing image processing, and is connected to another image processing apparatus over a network, as well as a control program for the same and an image processing system including the above image processing apparatus.

2. Description of the Related Art

When a system including image processing apparatuses such as MFPs (Multi-Function Peripherals) receives a job (which will be merely referred to as a "job" hereinafter) of performing image processing such as printing or transmission of scanned images from a Personal Computer (PC) or the like connectable to the system, the image processing apparatus stores the received job. When the image processing apparatus stores a plurality of jobs, it manages a processing order of the jobs and others. If the system includes a server, the server may manage, e.g., the order of output of the plurality of jobs to the image processing apparatus.

In this system, Japanese Laid-Open Patent Publication No. 2002-297332 has disclosed a technique, in which a print processing device stores a job of printing executed thereby, and will transfer the job to another print processing device for performing reprinting when the job is to be reprinted.

When a user enters a job in a conventional print processing device, an error may occur in the print processing device, or such a situation may occur that another job of a large size is already entered or volumes of jobs are already entered. In this case, the user must wait a long time until the printing of the job entered by the user is executed.

In connection with the above disadvantage, Japanese Laid-Open Patent Publication No. 2002-189581 has disclosed a technique for a system in which a plurality of printers are connected over a network. According to this technique, when an error occurs in a printer receiving a job, another appropriate printer connected over the network is found, and the job is transferred to the found printer. Japanese Laid-Open Patent Publication No. 2001-109595 has disclosed a technique relating to transfer of a job between printers, and particularly a technique managing transfer conditions by a server.

According to the techniques disclosed in Japanese Patent Laid-Open Patent Publication Nos. 2002-189581 and 2001-109595, it can be considered that a time required until execution of the job can be reduced, for example, even when an error occurred in the printer receiving the job.

However, according to the technique disclosed in these publications, selection of the printer as the destination is performed on the system side.

Therefore, when the conventional image processing system transfers the job from the image processing apparatus, in which the job was entered, to another image processing apparatus, it is necessary to determine and identify the image processing apparatus of the destination.

Meanwhile, when the user intends to transfer the job to the image processing apparatus which is desired by the user at this point in time, the user must perform complicated operations by himself/herself More specifically, the user must cancel the job on the image processing apparatus in which the job was entered, and must enter the job in a desired different image processing apparatus after confirming, e.g., that an error has not occurred.

For reentering the job, the user must go to a place of the desired different image processing apparatus to confirm, e.g., that there is no error. Then, the user brings an original document to that place, and causes the different image processing apparatus to read the original document. After this reading, the user returns to a place of a PC connected over the network, and performs processing for entering a job. Therefore, the user must perform complicated processing.

When it is necessary to log in to the different image processing apparatus for executing the job by this different image processing apparatus, it may be necessary to determine, e.g., whether the user is registered in this image processing apparatus or not. This requires the user to perform further complicated operations.

SUMMARY OF THE INVENTION

The invention has been made in view of the above matters, and an object of the invention is to provide an image processing system capable of operating such that a job entered in an image processing apparatus can be output by another image processing apparatus desired by a user without requiring the user to perform complicated processing. The object is also to provide an image processing apparatus and a control program for the same.

According to the invention, an image processing system includes a first image processing apparatus executing a job of processing an image, and a second image processing apparatus connectable to the first image processing apparatus over a network. The second image processing apparatus includes an authentication unit authenticating a user. The first image processing apparatus includes a job storing unit storing the job in a manner linked to information specifying the user, and a job transferring unit transferring to the second image processing apparatus the job linked to the information specifying the user authenticated by the authentication unit in the job storing unit.

According to the invention, an image processing apparatus for executing a job of processing an image is connectable to a different image processing apparatus authenticating a user over a network, and includes a job storing unit storing the job in a manner linked to information specifying the user, a job processing unit executing the job stored in the job storing unit, and a job transferring unit transferring to the different image processing apparatus the job linked to the information specifying the user authenticated by the different image processing apparatus.

According to the invention, a control program of an image processing apparatus being connectable over a network to a different image processing apparatus authenticating a user and executing a job of processing an image, causes the image processing apparatus to execute the steps of storing the job in a manner linked to information specifying the user; selecting the job stored in the manner linked to the information specifying the user authenticated by the different image processing apparatus from the stored jobs, and transferring the selected job to the different image processing apparatus.

According to the invention, when the image processing apparatus authenticates the user, this image processing apparatus can transfer the job of the user stored therein to the different image processing apparatus.

Therefore, the user desiring transfer of the job can transfer the job to the image processing apparatus desired as the destination of the job by performing an operation for authentication on the desired image processing apparatus.

According to the invention, therefore, the job once stored in the image processing apparatus can be output by the different image processing apparatus desired by the user (i.e., the apparatus in which the user authentication is performed) without requiring the user to perform complicated operations.

The foregoing and other objects, features, aspects and advantages of the present invention will become more apparent from the following detailed description of the present invention when taken in conjunction with the accompanying drawings.

BRIEF DESCRIPTION OF THE DRAWINGS

FIG. 11 shows an example of a job management table stored in a memory of the MFP in FIG. 4.

FIG. 12 illustrates another example of the job management table stored in the memory of the MFP in FIG. 4.

FIG. 13 illustrates still another example of the job management table stored in the memory of the MFP in FIG. 4.

FIG. 17 illustrates another example of the job management table stored in the memory of the MFP in FIG. 4.

FIG. 18 illustrates still another example of the job management table stored in the memory of the MFP in FIG. 4.

DESCRIPTION OF THE PREFERRED EMBODIMENTS

First Embodiment

Figure 1:
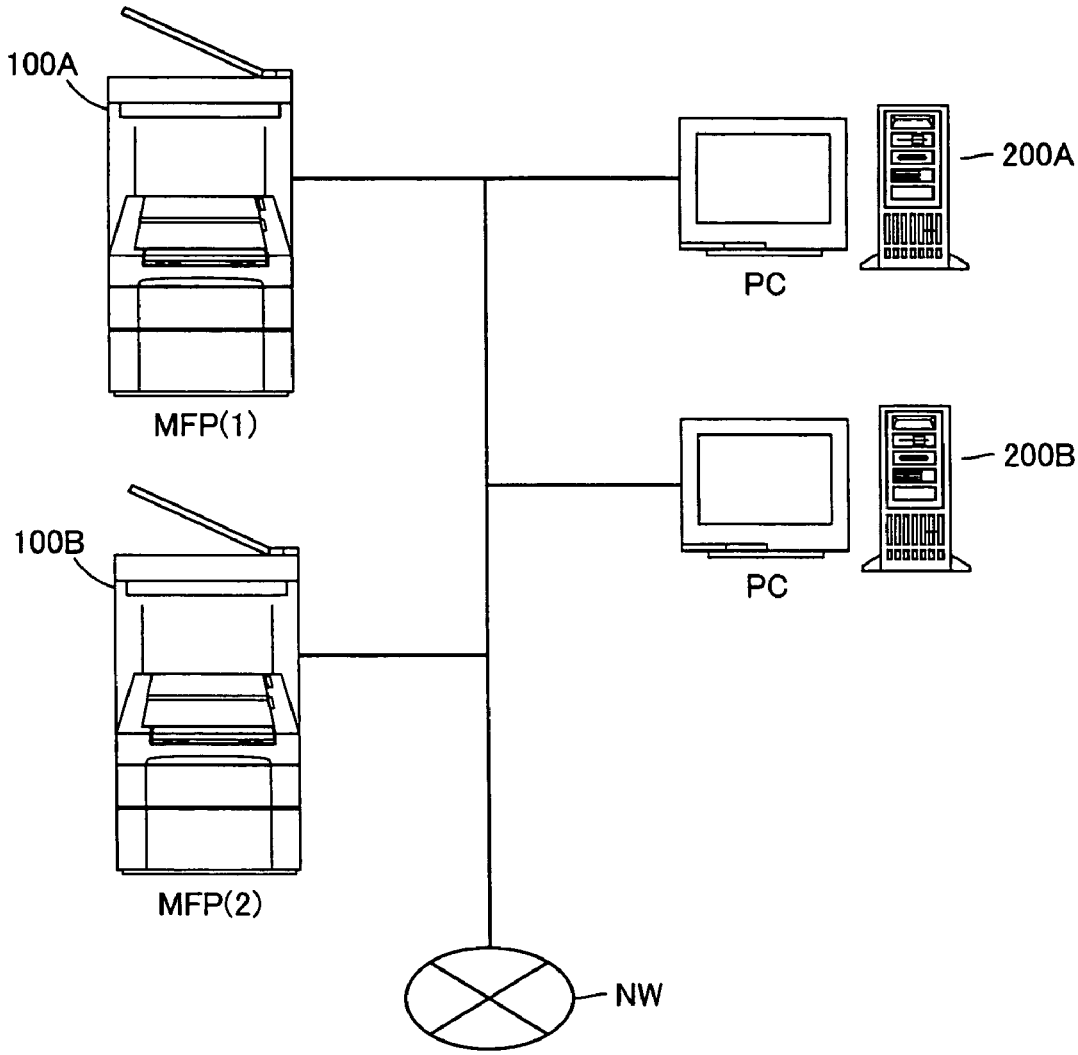
FIG. 1 shows a structure of an image processing system including MFPs which are image processing apparatuses of a first embodiment of the invention.

Referring to FIG. 1, an image processing system includes MFPs 100A and 100B connected to a network as well as a plurality of PCs 200A and 200B. Since the network is connected to the Internet NW, MFPs 100A and 100B as well as PCs 200A and 200B can access external devices over the Internet NW. MFPs 100A and 100B can connect to a line such as a PSTN (Public Switched Telephone Network) for facsimile transmission or the like. Each of the numbers of MFPs and PCs connected to the network is not restricted to two.

Figure 2:
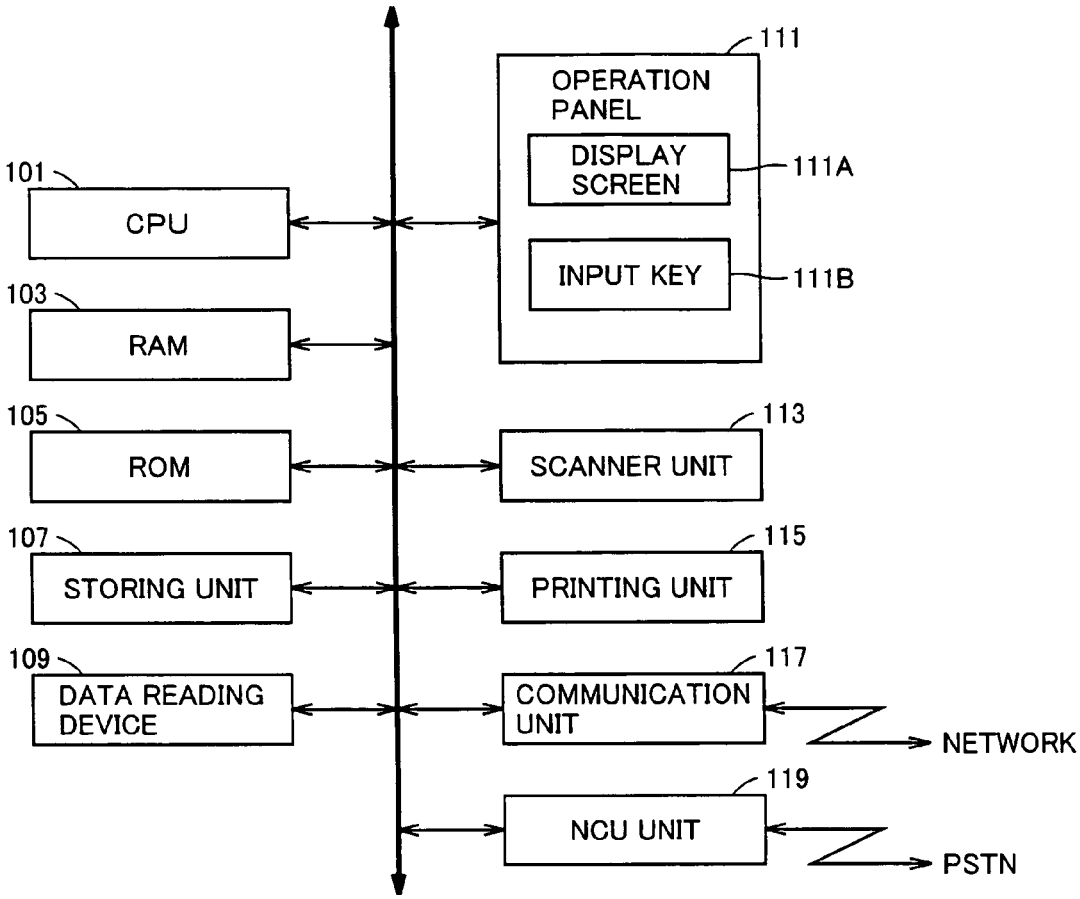
FIG. 2 shows a hardware structure of the MFP in FIG. 1.

Referring to FIG. 2, MFP 100A includes a CPU 101 performing whole control of MFP 100A, a RAM (Random Access Memory) 103 temporarily storing data, a ROM (Read Only Memory) 105 storing programs and constants, a storing unit 107 for storing image data and others, a read device 109 for reading data recorded on a record medium such as a CD-ROM (Compact Disk Read Only Memory) attachable to MFP 100A, an operation panel 111 accepting operations by the user, a scanner unit 113, a printing unit 115 printing image data on a paper sheet, a communication unit 117 for connecting to the network and a NCU (Network Control Unit) 119 for connecting to the PSTN.

Operation panel 111 includes a display screen 111A for displaying a state of the MFP and choices of commands to the user, and an input key 111B. Display screen 111A and input key 111B may be formed by a liquid crystal display and a touch panel arranged thereon.

Figure 3:
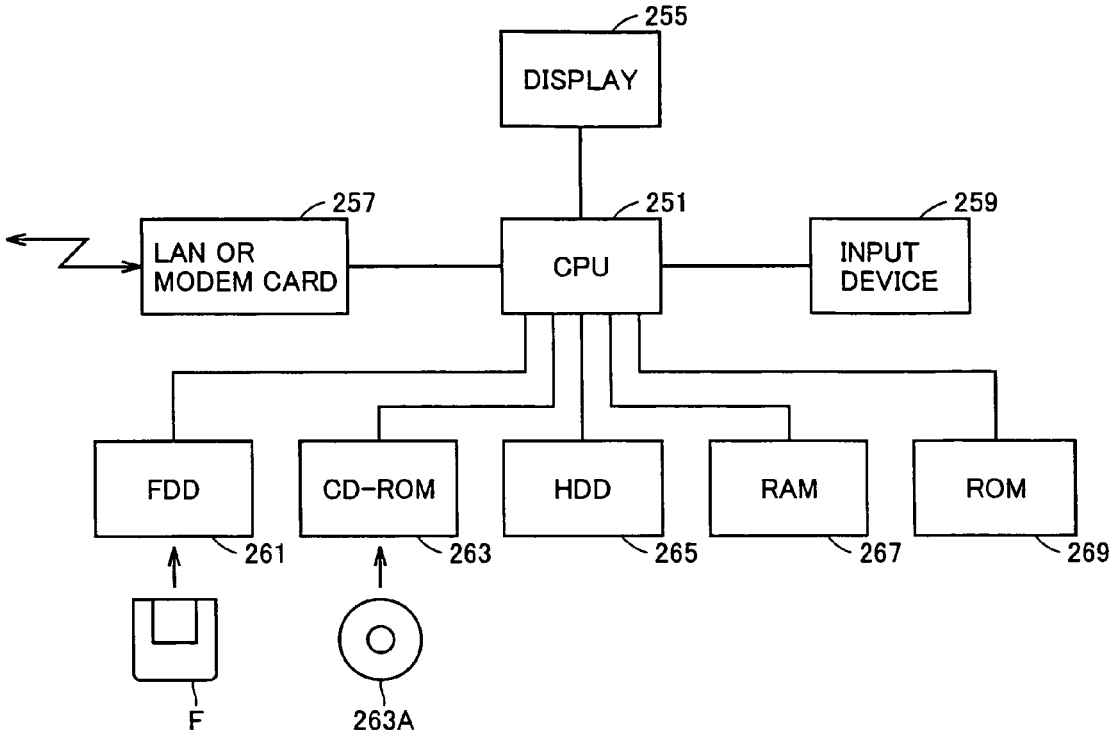
FIG. 3 is a block diagram showing a hardware structure of a PC (personal computer) in FIG. 1.

Referring to FIG. 3, a hardware structure of PC 200A in FIG. 1 will now be described. Since PC 200B has the same hardware structure as PC 200A, description of the hardware structure of PC 200B is not repeated.

Referring to FIG. 3, PC 200A includes a CPU 251 controlling the whole device, a display 255, a card unit 257 utilized for connection to the network and external communication, an input device 259 formed of, e.g., a keyboard and a mouse, a flexible disk drive 261, a CD-ROM drive 263, a hard disk drive 265, a RAM 267 and a ROM 269. The card unit 257 is formed of a LAN (Local Area Network) card and/or a modem card.

CPU 251 can read data such as a program recorded on a flexible disk F via flexible disk drive 261, and can read data such as a program recorded on a CD-ROM 263A via CD-ROM drive 263.

Figure 4:
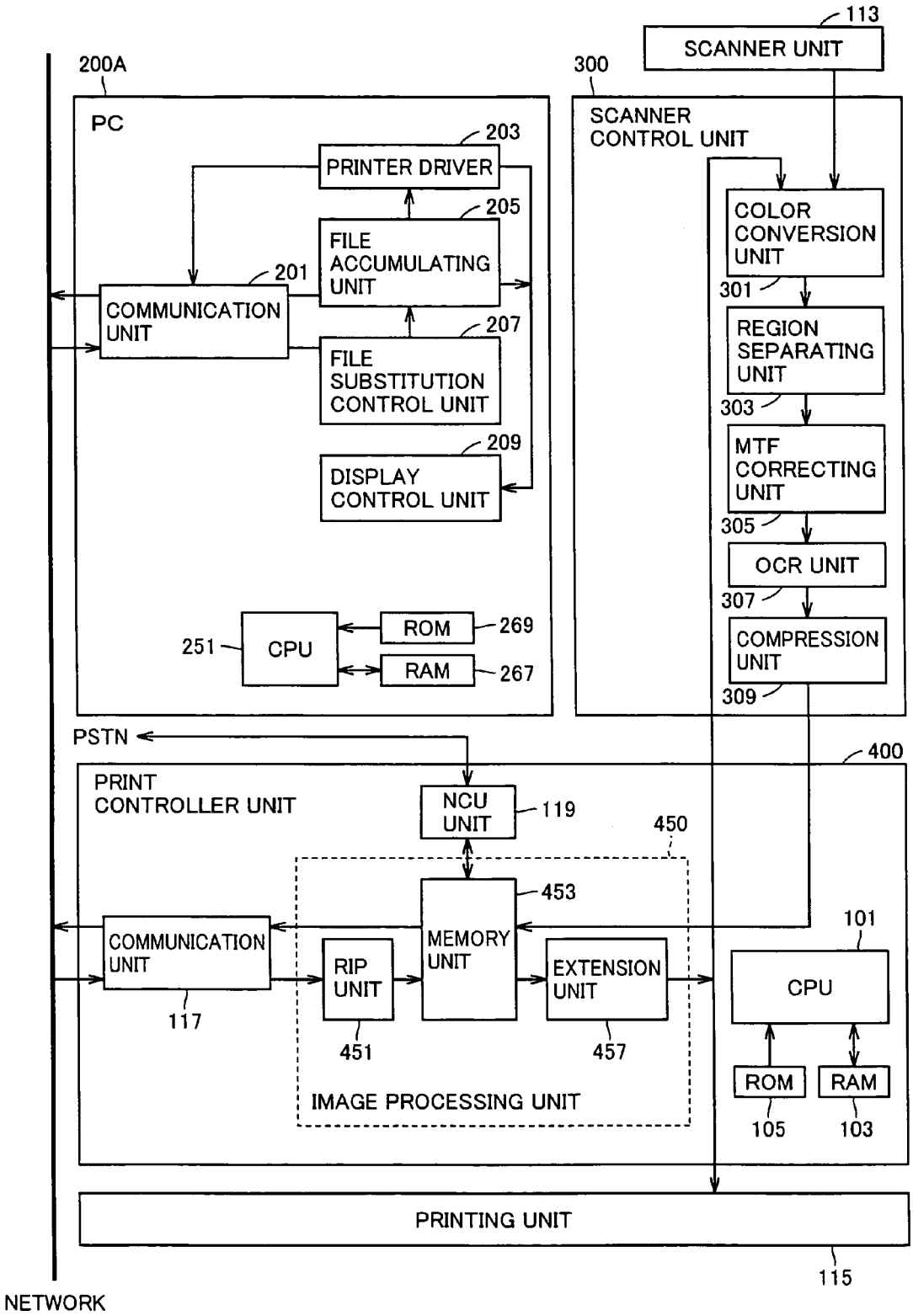
FIG. 4 is a functional block diagram illustrating functional structures of the MFP and PC in FIG. 1.

Referring to FIG. 4, PC 200A includes CPU 251, ROM 269 and RAM 267 as described with reference to FIG. 3.

PC 200A includes a communication unit 201 connected to the network for transmitting and receiving data, a printer driver 203 for transmitting the data to MFP 100, a file accumulating unit 205 for accumulating image files, data files and others, a file substitution control unit 207 performing substitution processing on files accumulated in file accumulating unit 205 (e.g., substitution of a new file for an old file), and a display control unit 209 controlling display of images and text data.

MFP 100A includes scanner unit 113, a scanner control unit 300, a print controller 400 and a printing unit 115.

Scanner control unit 300 includes a color conversion unit 301 effecting color conversion on image data read by scanner unit 113, a region separating unit 303 separating regions in the image data, a MTF correcting unit 305 performing MTF correction, an OCR (Optical Character Reader) unit 307 appropriately reading character data from the image data and a compression unit 309 compressing the image data.

Print controller 400 includes NCU unit 119 for connecting to the PSTN, communication unit 117 connected to the network for transmitting and receiving the data, and an image processing unit 450 processing the image data, and also includes CPU 101, RAM 103 and ROM 105 which are shown in FIG. 2.

Image processing unit 450 includes a memory 453 for accumulating the jobs and information managing the jobs, a RIP (Raster Image Processor) unit 451 developing data described in numerical formulas or PostScript into a bit map, and an extension unit 457 extending the data.

For scanning an original document by MFP 100A and storing the obtained image data in PC 200A, scanner unit 113 first reads the image, and image processing unit 450 effects the color conversion and region separation on the original document read by scanner unit 113. Thereafter, the compressed data is transmitted in a file format already set to a designated destination.

For transmitting the original document via a facsimile from MFP 100A, image processing unit 450 first processes the original document read by scanner unit 113, and temporarily stores it as image data for transmission formed of binary image data. NCU unit 119 is connected to a line such as the PSTN and performs line control so that the data is transmitted to the PSTN line according to a facsimile number of the destination.

According to the image processing system of the embodiment, storing unit 107 of each MFP connected to the network stores a user name and a password for each user in a manner linked to each other. For utilizing directly or via the PC each MFP connected to the network, the user must log in after the user is authenticated by entering the user name and the password.

The image processing system of the embodiment identifies each MFP connected to the network as MFP(N) (N is an integer) such as MFP(1) or MFP(2). According to this embodiment, MFP 100A is identified as MFP(1), and MFP 100B is identified as MFP(2).

Figure 5:
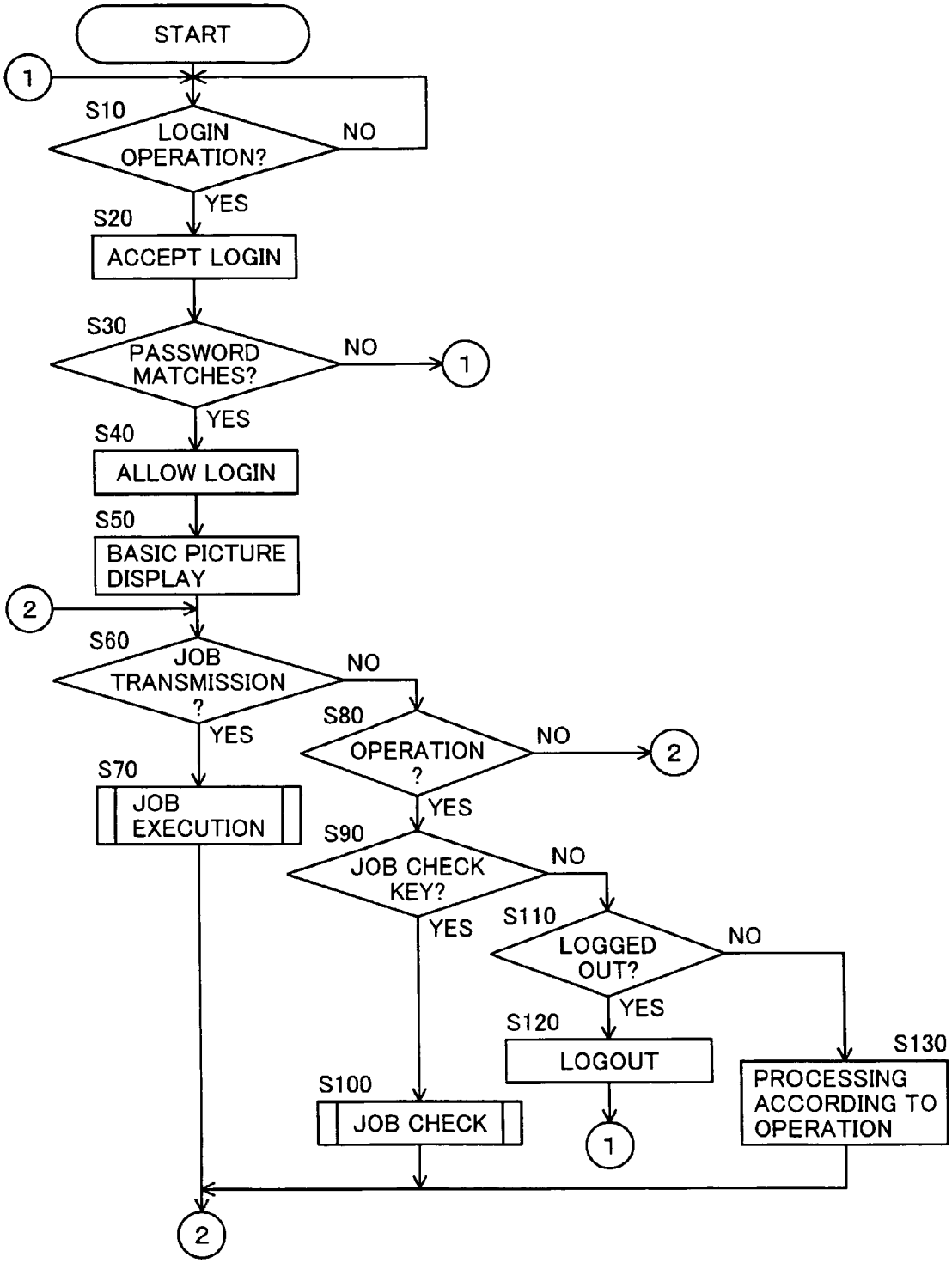
FIG. 5 is a flowchart of processing executed by a CPU (Central Processing Unit) of the MFP in FIG. 1 after power-on and completion of initial setting of the MFP.

Referring to FIG. 5, description will now be given on an operation of each MFP in the image processing system of the embodiment. FIG. 5 is a flowchart of processing which is executed by CPU 101 of MFP 100A after power-on and initial setting of MFP 100A.

Referring to FIG. 5, CPU 101 determines in a step S10 whether the user performed the login operation or not. When CPU 101 determines that the login operation is performed, it advances the process to a step S20.

Figure 6:
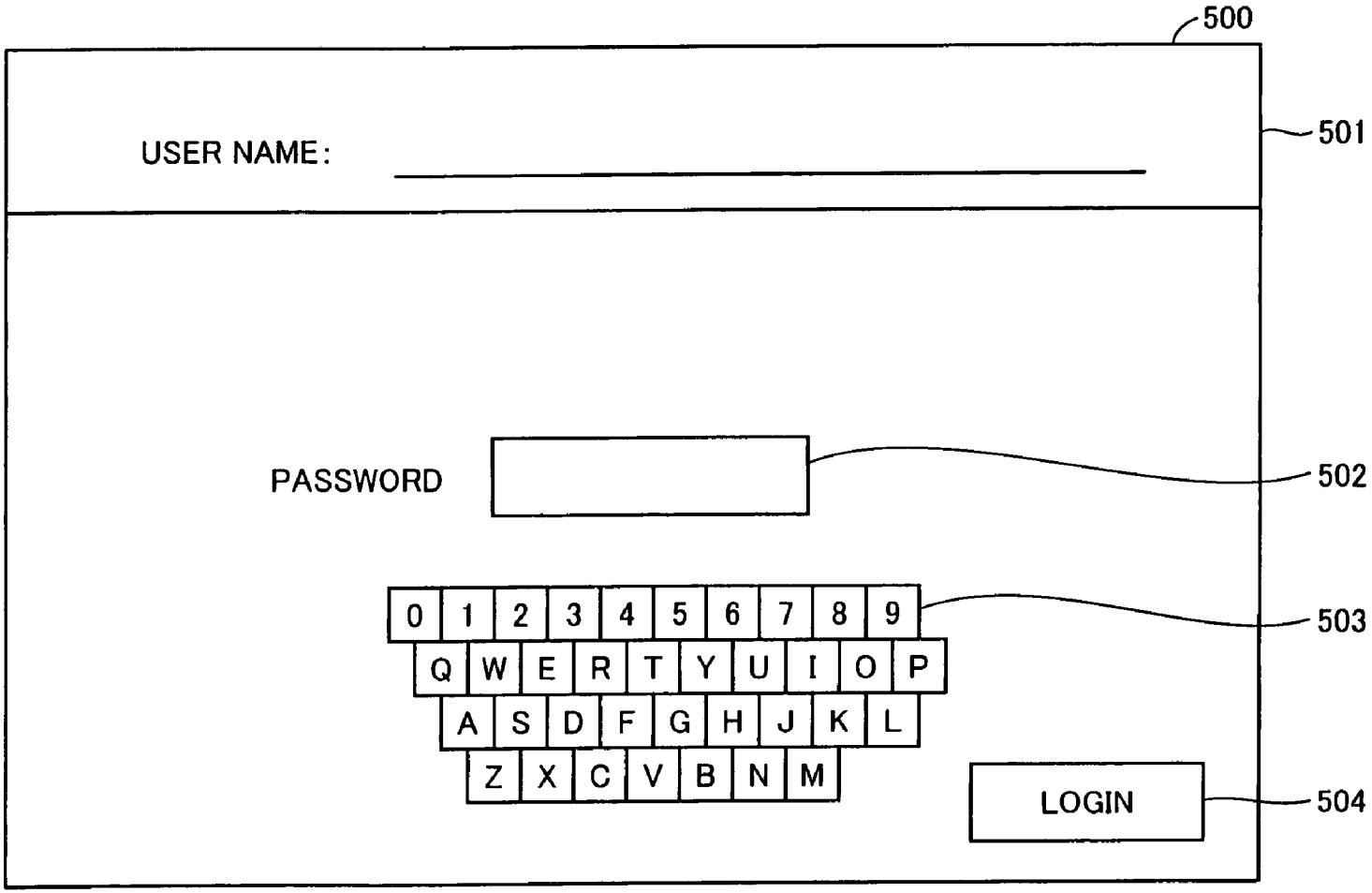
FIG. 6 shows an example of a standby picture displayed on a display of the MFP in FIG. 2.

When the processing in step S10 is being executed, MFP 100A is on standby, and displays a standby picture 500 on display screen 111A as shown in FIG. 6.

Referring to FIG. 6, standby picture 500 provides a user name entry field 501, a password entry field 502 and an input key display field 503 formed of a plurality of touch keys corresponding to letters of the alphabet and numbers. The user appropriately operates the touch keys included in input key display field 503 to enter the user name and the password in user name entry field 501 and password entry field 502, respectively.

Standby picture 500 displays a login button 504 formed of a touch key. By operating login button 504, the user performs the login operation with the user name and the password which are currently entered in user name entry field 501 and password entry field 502, respectively.

The login operation detected in step S10 includes not only the operation on operation panel 111 of MFP 100A but also transmission of the information for login by PC 200A or the like.

Figure 7:
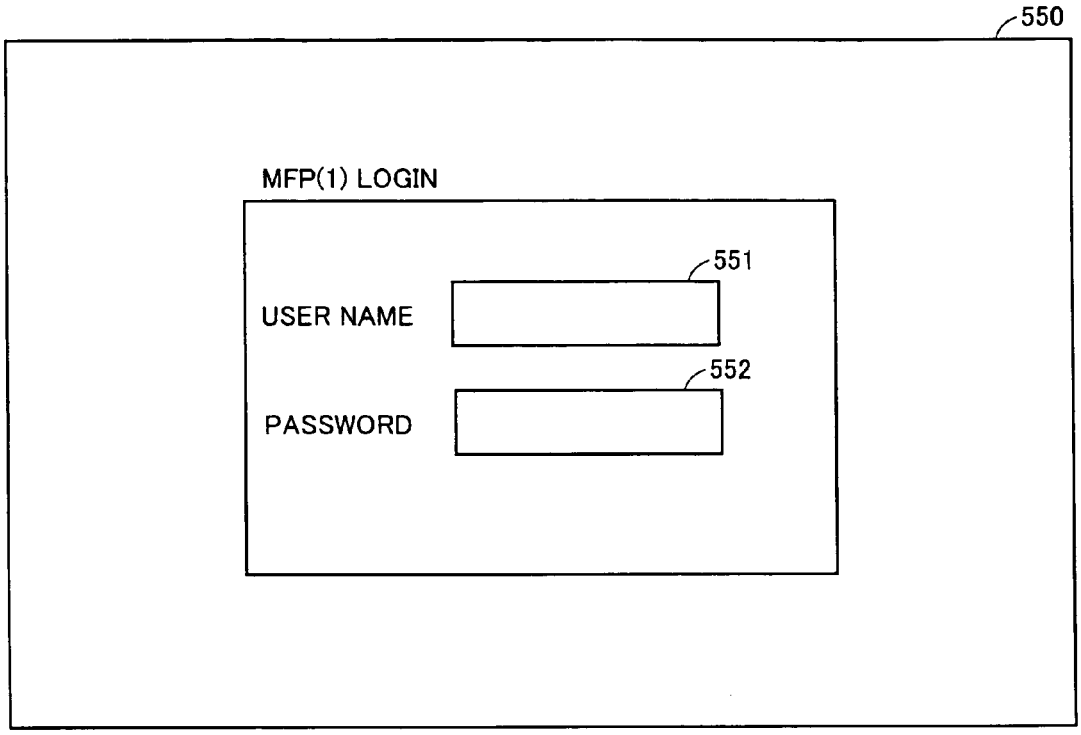
FIG. 7 shows an example of a login picture displayed on a display of the PC in FIG. 1.

FIG. 7 shows an example of a picture (i.e., a picture for login) displayed on display 255 of PC 200A for logging in to MFP 100A.

Referring to FIG. 7, a login screen 550 displays a user name entry field 551 and a password entry field 552. Login screen 550 also displays information ("LOG IN MFP(1)") representing the MFP to which the user can log in.

After entering the user name and the password in user name entry field 401 and password entry field 402, respectively, the user of PC 200A performs an appropriate operation so that PC 200A transmits the information for login to MFP 100A.

Referring to FIG. 5 again, when it is determined in step S10 that the operation for login is performed, CPU 101 accepts the information (user name and password) entered for logging in, and determines in a step S30 whether the accepted password matches with the password which is stored and linked to the accepted user name. When matching occurs, the process proceeds to a step S40. When matching does no occur, CPU 101 performs processing such as display of a message "Password is Invalid" on display screen 111A, and then returns the process to step S10.

In a step S40, CPU 101 performs processing for allowing the login of the user of the user name entered in user name entry field 501. Thereby, the user of the user name accepted in step S20 logs in to MFP 100A. The user, who has logged in, will be referred to as a "login user" hereinafter.

Figure 8:
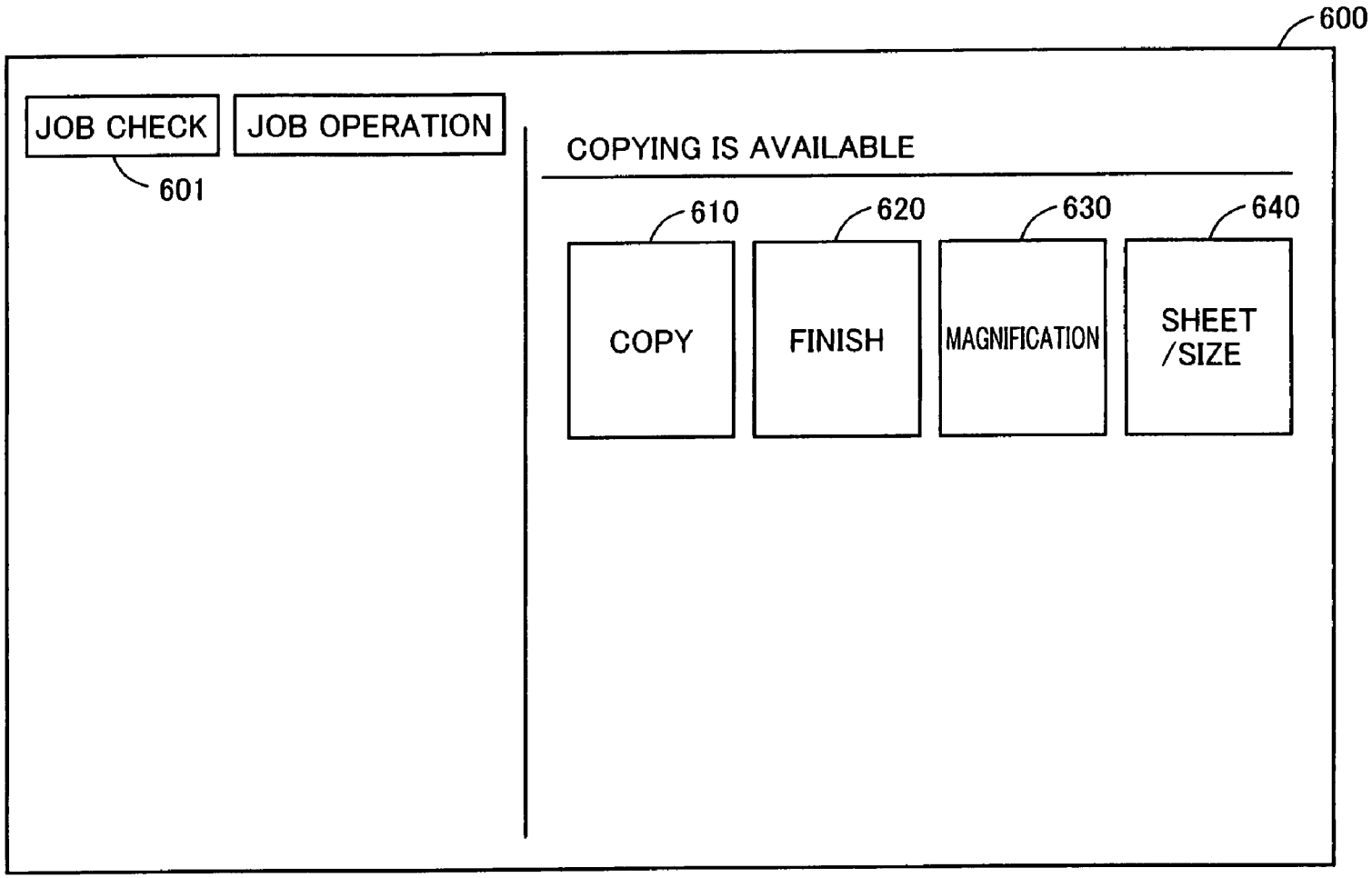
FIG. 8 shows an example of a basic picture displayed on a display screen of the MFP in FIG. 2.

In a step S50, CPU 101 displays a basic picture on display screen 111A, and advances the process to a step S60. FIG. 8 shows an example of the basic picture.

Referring to FIG. 8, a basic picture 600 is an operation picture displayed when MFP 100A executes a copy operation. Basic picture 600 provides a job confirmation key 601 which is used by the login user for confirming the job already entered, and also provides indication fields 610, 620, 630 and 640 indicating various settings for the copy operation.

Referring to FIG. 5 again, CPU 101 determines in step S60 whether the job is transmitted from the PC to MFP 100A over the network or not. When it is determined that the job is transmitted, the process proceeds to a step S70. When it is determined at this point in time that the job is not transmitted, the process proceeds to a step S80.

In step S80, CPU 101 determines whether input key 111B on operation panel 111 is operated or not. When it is determined that input key 111B is operated, the process proceeds to a step S90. When it is determined at this point in time that input key 111B is not operated, the process returns to step S60.

In step S90, CPU 101 determines whether the operation detected in step S80 is performed on job confirmation key 601 (see FIG. 8) or not. When it is determined that the operation is performed on job confirmation key 601, the process proceeds to a step S100. Otherwise, the process proceeds to a step S110.

In step S110, CPU 101 determines whether the operation detected in step S80 is the operation for logging out or not. When it is the operation for logging out, the process proceeds to a step S120. Otherwise, the process proceeds to a step S130.

In step S130, CPU 101 executes the processing corresponding to contents of the operation detected in step S80, and then returns the process to step S60.

In step S120, processing for logging out is executed for the login user, and the process returns to step S110.

In step S70, CPU 101 executes the job execution processing for executing the printing of the transmitted job, and returns the process to step S60.

Figure 9:
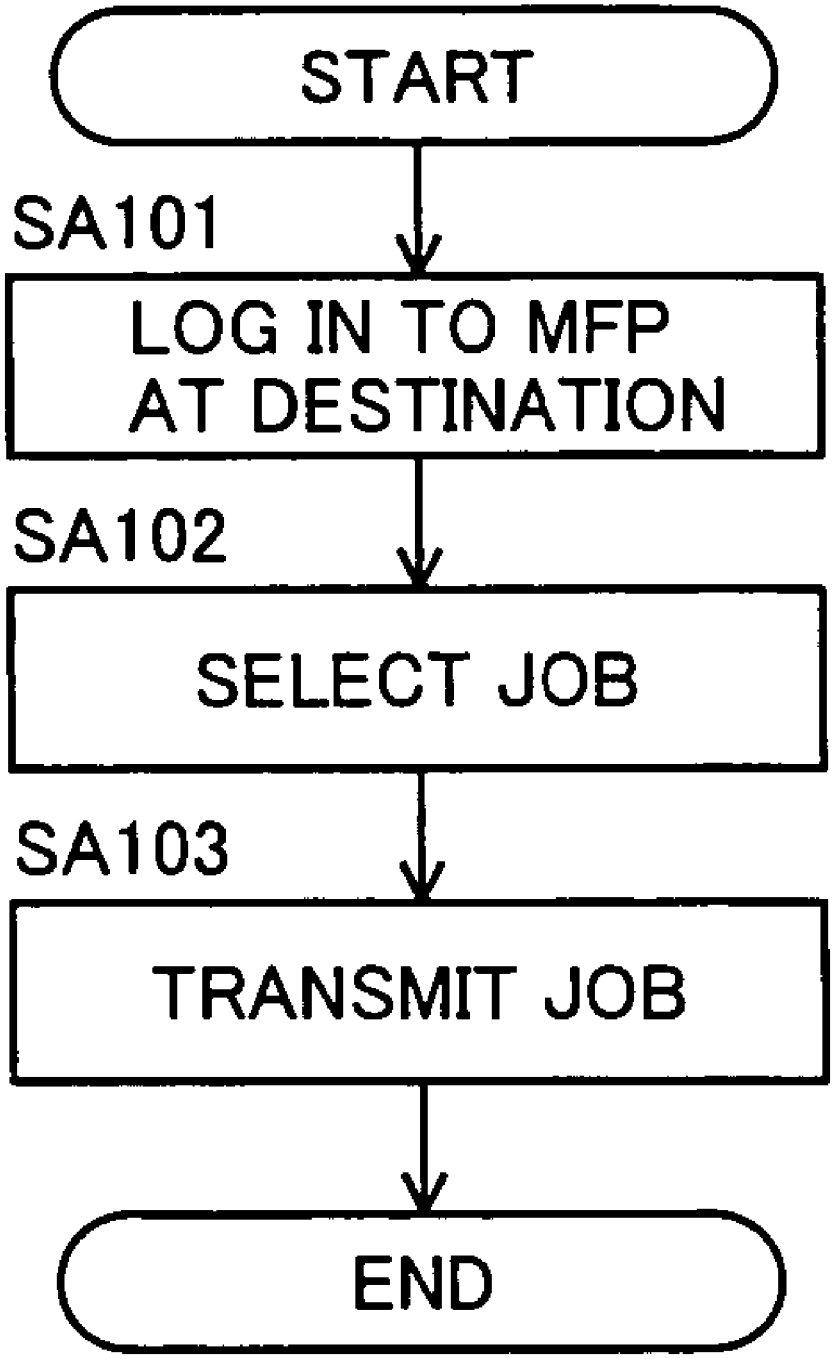
FIG. 9 is a flowchart of processing executed for transmitting a job from the CPU of the PC in FIG. 1 to the MFP.

Description will now be given on the processing, which is executed by PC 200A (or 200B) for transmitting the job to MFP 100A, with reference to a flowchart of FIG. 9 illustrating this processing.

Referring to FIG. 9, CPU 251 in PC 200A first executes an operation in a step SA101 for logging in to the MFP (e.g., MFP 100A) desired as the job destination, and advances the processing to a step SA102.

In step SA102, CPU 251 selects the job to be transmitted.

In a step SA103, CPU 251 transmits the job selected in step SA102 to the MFP to which it has logged in, and ends the processing.

Contents of the job execution processing, which is executed in step S70 by MFP 100A, will now be described with reference to FIG. 10 which is a flowchart of a subroutine of this processing.

Figure 10:
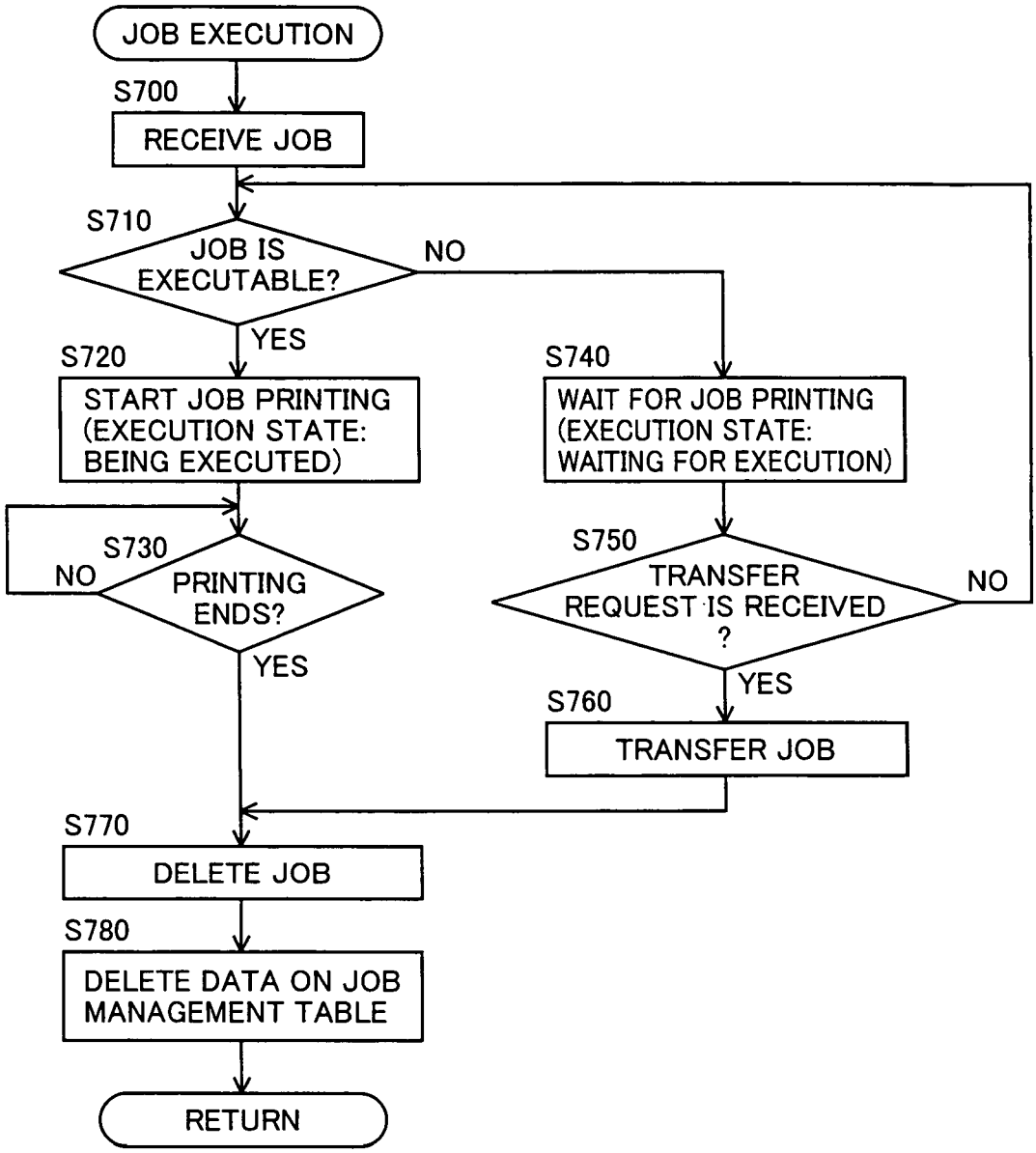
FIG. 10 is a flowchart of a subroutine of job execution processing in FIG. 5.

Referring to FIG. 10, CPU 101 performing the job execution processing first receives the transmitted job in a step S700, and stores it in memory 453. In step S700, CPU 101 updates information managing the jobs stored in memory 453 based on the storage of the new job.

FIG. 11 illustrates a job management table which is an example of information managing the jobs. In the job management table, file names of files to be printed, user names of users, who registered respective jobs, and information (execution states) indicating whether the jobs are being executed or not are linked to each other.

In the state illustrated in FIG. 11, the job management table stores the information relating to three jobs. The first job relates to printing of the file of the file name "Micro", and is registered by the user of the user name "Tanaka". The execution state of this job is "being executed". The second job relates to printing of the file of the file name "FILE1", and is registered by the user of the user name "Nakamura". The execution state of this job is "waiting for processing". The third job relates to printing of the file of the file name "PAT", and is registered by the user of the user name "Tanaka". The execution state of this job is "waiting for processing".

When a new job is received in step S700, information relating to the new job is added to the job management table. For example, the job management table is updated from the state in FIG. 11 to the state in FIG. 12.

The job management table in FIG. 12 differs from that in FIG. 11 in that information relating to a fourth job is added. This new information represents that the file name of the file to be printed is "Micro", the user name of the user registering it is "Tanaka" and the execution state is "waiting for processing".

Referring to FIG. 10 again, CPU 101 receiving the job determines in a step S710 whether MFP 100A itself is currently in the state where it can immediately execute the received job or not. Specifically, this determination is performed by determining whether information is registered in the job management table or not, and whether an error such as jamming has occurred in printing unit 115 or not. When it is determined that MFP 100A can immediately execute the job, the process proceeds to a step S720. When it is determined that MP 100A cannot immediately execute the job because it is executing another job, or for another reason, the process proceeds to a step S740. CPU 101 determines that the job can be executed immediately, for example, in such a case that information is not registered in the job management table, and no error is detected in printing unit 115. In the case where the job management table can manage the remaining time for execution of the job, CPU 101 determines that MFP 100A cannot immediately execute the job even when the information of another job is registered in the job management table, if no job is waiting for the processing and the remaining time of the job, which is being executed, is shorter than a predetermined time.

In step S720, CPU 101 drives printing unit 115 to start the printing of the job transmitted thereto, and then performs the processing in a step S730. At this point in time, CPU 101 updates the job management table such that the execution state of the job transmitted thereto is "being executed".

In next step S730, CPU 101 determines whether the printing of the job started in step S720 ends or not. When it ends, CPU 101 advances the process to a step S770.

In step S740, CPU 101 keeps the printing of job in a standby state. In this state, the execution state of the job in the job management table is "waiting for processing". In a step S750, CPU 101 determines whether it receives a transfer request for the job, of which information is registered in its own job management table, from another MFP on the network. When it is received, the process proceeds to a step S760. When it is not received, the process returns to step S710.

In step S760, CPU 101 transmits the job corresponding to the received transfer request to the MFP which transmitted the transfer request, and advances the process to step S770.

In step S770, CPU 101 deletes data (data and others of the file to be printed) of the job, which is determined as the job already subjected to the printing in step S730, or is transferred in step S760, from memory 453 storing it.

In step S780, CPU 101 deletes the data corresponding to the job deleted in step S770 from the job management table, and returns the processor.

For example, when the information illustrated in FIG. 12 is stored as the job management table, and the CPU 101 receives the transfer request for the fourth job from another MFP, CPU 101 transfers the fourth job to the MFP requesting it (step S760), deletes the transferred job from memory 453 (step S770) and also deletes the data corresponding to the deleted job from the job management table as illustrated in FIG. 13 (step S780).

Contents of the job checking processing executed in step S100 by MFP 100A will now be described with reference to FIG. 14 which is a flowchart of a subroutine of this processing.

In the job checking processing, CPU 101 first produces data for displaying a job check picture in a step S1100.

The processing of producing the job check picture will now be described with reference to FIG. 15 which is a flowchart of a subroutine of this processing.

Figure 15:
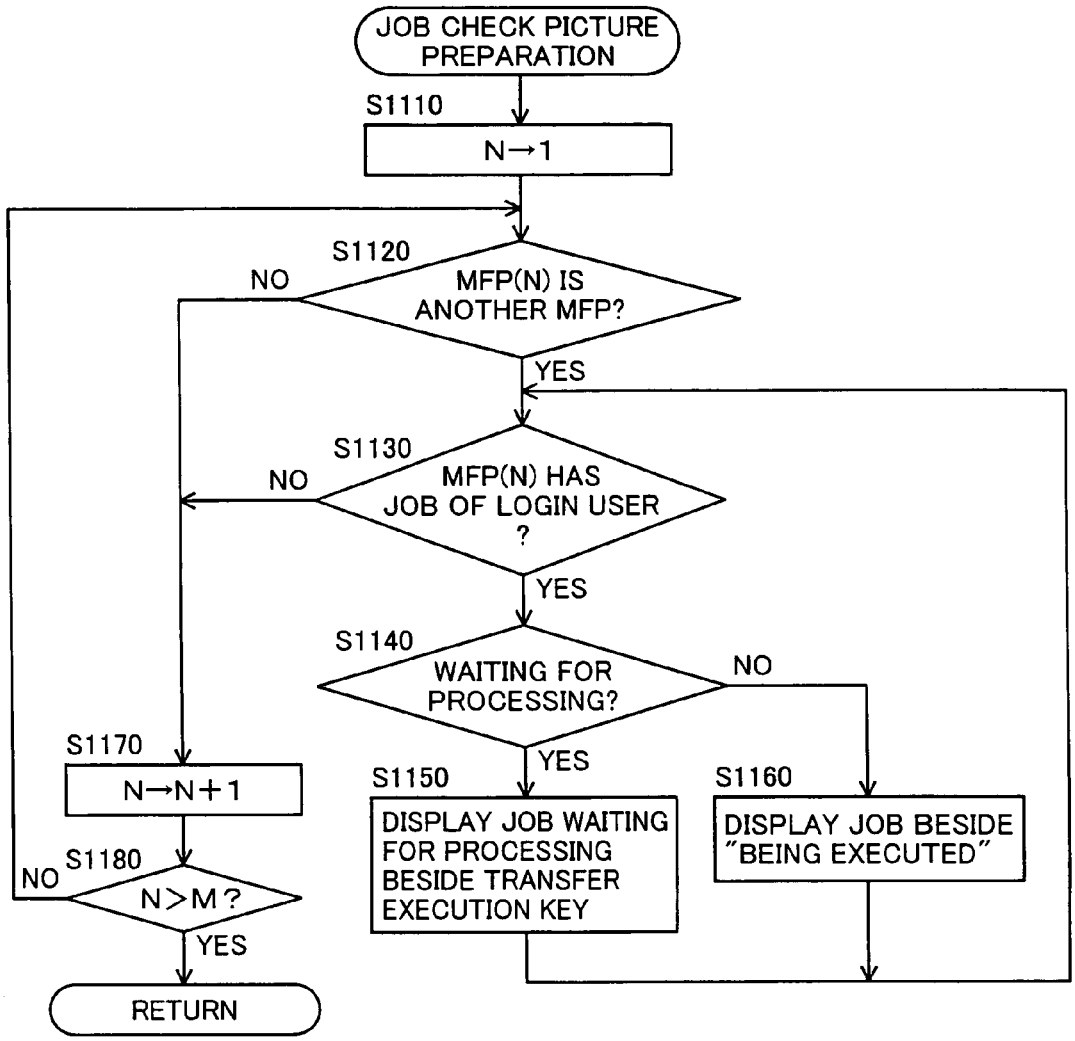
FIG. 15 is a flowchart of a subroutine of job check picture preparing processing in FIG. 14.

Referring to FIG. 15, CPU 101 performing the processing of producing the job check picture first sets a variable N specifying the MFP on the network to one in a step S1110, and advances the process to a step S1120.

In step S1120, CPU 101 determines whether MFP(N) is its own MFP or not. When it is another MFP, the process proceeds to a step S1130. When it is its own MFP, the process proceeds to a step S1170.

In step S1130, CPU 101 determines whether a job registered by its own current login user is present in the MFP(N) or not. More specifically, CPU 101 determines whether the job management table in the MFP(N) in question contains the job of the user name of its own current login user or not. When CPU 101 determines that the job is contained, it advances the process to a step S1140. Otherwise, CPU 101 advances the process to step S1170.

In step S1140, CPU 101 determines whether the job execution state determined in step S1130 is "waiting for program" or not. When it is "waiting for processing", CPU 101 advances the process to a step S1150. Otherwise, i.e., when it is "being executed", CPU 101 advances the process to a step S1160.

In step S1150, CPU 101 produces the job check picture such that information relating to the job in the processing waiting state is displayed beside a touch key identified by "transfer execution key", and returns the process to step S1130.

In step S1160, CPU 101 produces the job check picture such that the information relating to the job is displayed beside a character string of "BEING EXECUTED".

The processing from step S1130 to step S1160 is repeated until all the jobs registered in the MFP(N) by the login user are processed.

In step S1170, CPU 101 updates N by adding one, and advances the process to a step S1180.

In step S1180, CPU 101 determines whether N exceeds the number (M) of the MFPs connected over the network or not. When N has not exceeded M, CPU 101 returns the process to step S1120. Otherwise, it returns the process to step S100 (FIG. 14).

By the processing at steps S1110, S1120, S1170 and S1180 in the job check picture producing processing, it is possible to determine in all the MFPs connected over the network whether the job registered by the login user is present or not.

Figure 16:
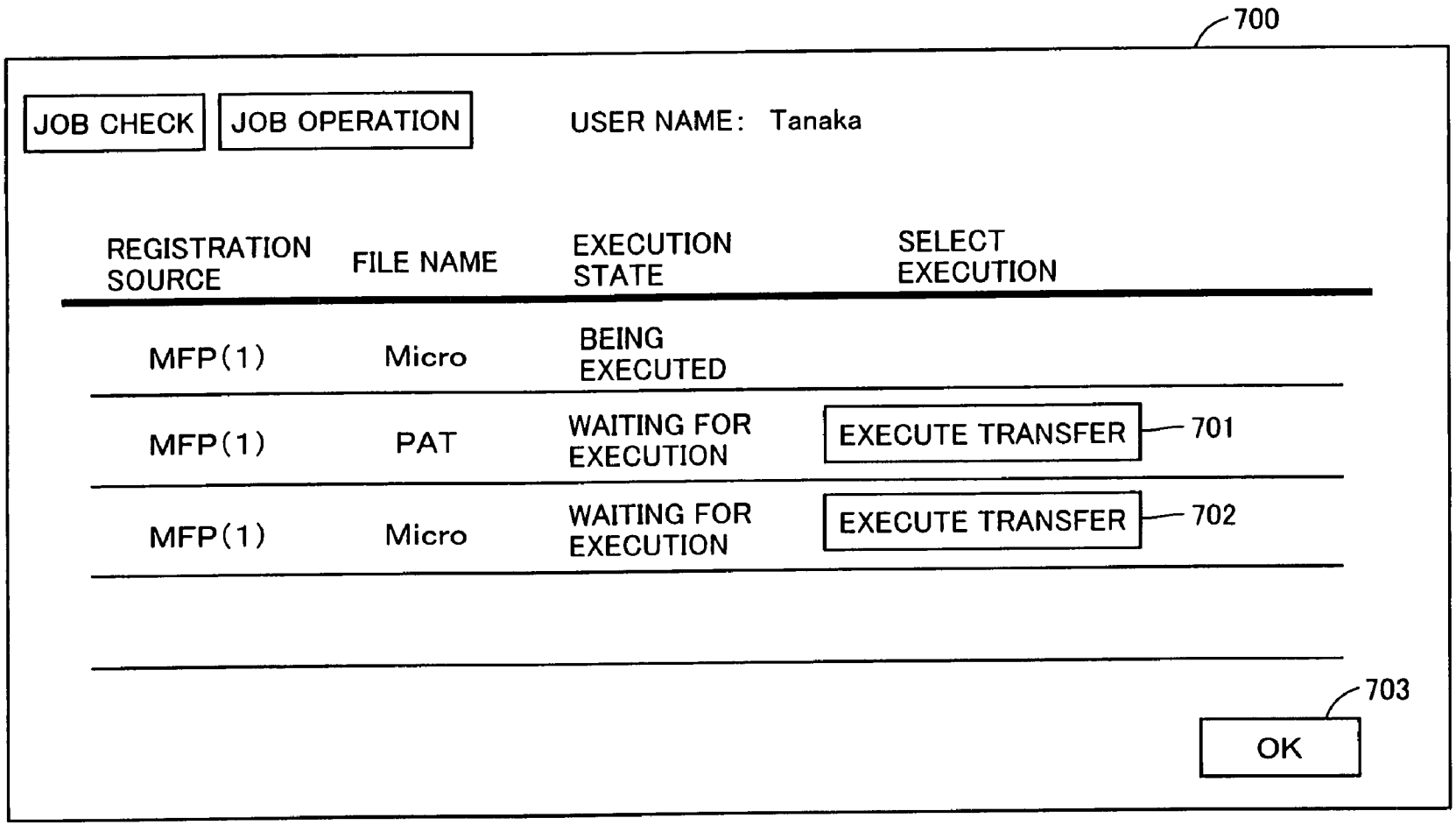
FIG. 16 shows an example of a job check picture displayed on a display screen of the MFP in FIG. 2.

FIG. 16 shows an example of the job check picture produced in the above manner.

Referring to FIG. 16, a job check picture 700 represents the user name ("Tanaka" in FIG. 16) of the login user, and the information of the jobs registered by the login user are represented in a list form. FIG. 16 shows the picture which is displayed when the job check processing is executed in the MFP(2) (MFP 100B).

In this list, "REGISTRATION SOURCE" gives the information specifying the MFPs where the jobs are registered, respectively. The "FILE NAME" and "EXECUTION STATE" are the same as those already described with reference to FIG. 11 and others. "SELECT EXECUTION" provides fields for displaying the transfer execution keys already described.

The contents in FIG. 16 contain information relating to three jobs. Transfer execution keys 701 and 702 are displayed for two jobs, which are "waiting for execution", among the three jobs.

Job check picture 700 also represents an OK key 703 to be operated by a user when the user does not intend to transfer the job.

Referring to FIG. 14 again, after producing the job check picture in step S1100, CPU 101 displays the job check picture on display screen 111A, and advances the process to a step S1210.

In step S1210, CPU 101 determines whether any one of the transfer execution keys is operated on the job check picture or not. When CPU 101 determines that the key is operated, it advances the process to a step S1220. When CPU 101 determines that the transfer execution key is not operated, and OK key 703 is operated, it returns the process to step S100 (FIG. 5).

In step S1220, CPU 101 transmits a transfer request, which requests transfer of the job to its own MFP, to the MFP in which the job corresponding to the operated transfer execution key is registered.

For example, when transfer execution key 702 is operated while job check picture 700 shown in FIG. 16 is being displayed, MFP 100B transmits a request, which requests transmission of the job bearing the file name of "Micro" displayed in the third position on job check picture 700, to MFP 100A (MFP(1)).

Referring to FIG. 14 again, when the transfer request is transmitted in step S1220, CPU 101 waits for the transmission of the job. When the job is transmitted, CPU 101 receives the job in a step S1230, and stores it in memory 453. In this operation, CPU 101 registers the information relating to the received job in the job management table.

For example, it is assumed that the job management table of the MFP(2) is in the state illustrated in FIG. 17, or the job management table of the MFP(1) is in the state illustrated in FIG. 12. FIG. 17 illustrates the state where information relating to the job is not registered in the job management table. In this state, it is assumed that MFP(2) transmits to MFP(1) the transfer request for the job related to the file name of "Micro" and waiting for the processing, and MFP(1) transfers the job to MFP(2) in response to the request thus transferred. In this case, the job management table of MFP(1) is updated to delete the data of the job transferred therefrom as illustrated in FIG. 13. The job management table of MFP(2) is updated to add the data of the job transferred thereto as illustrated in FIG. 18.

Figure 19:
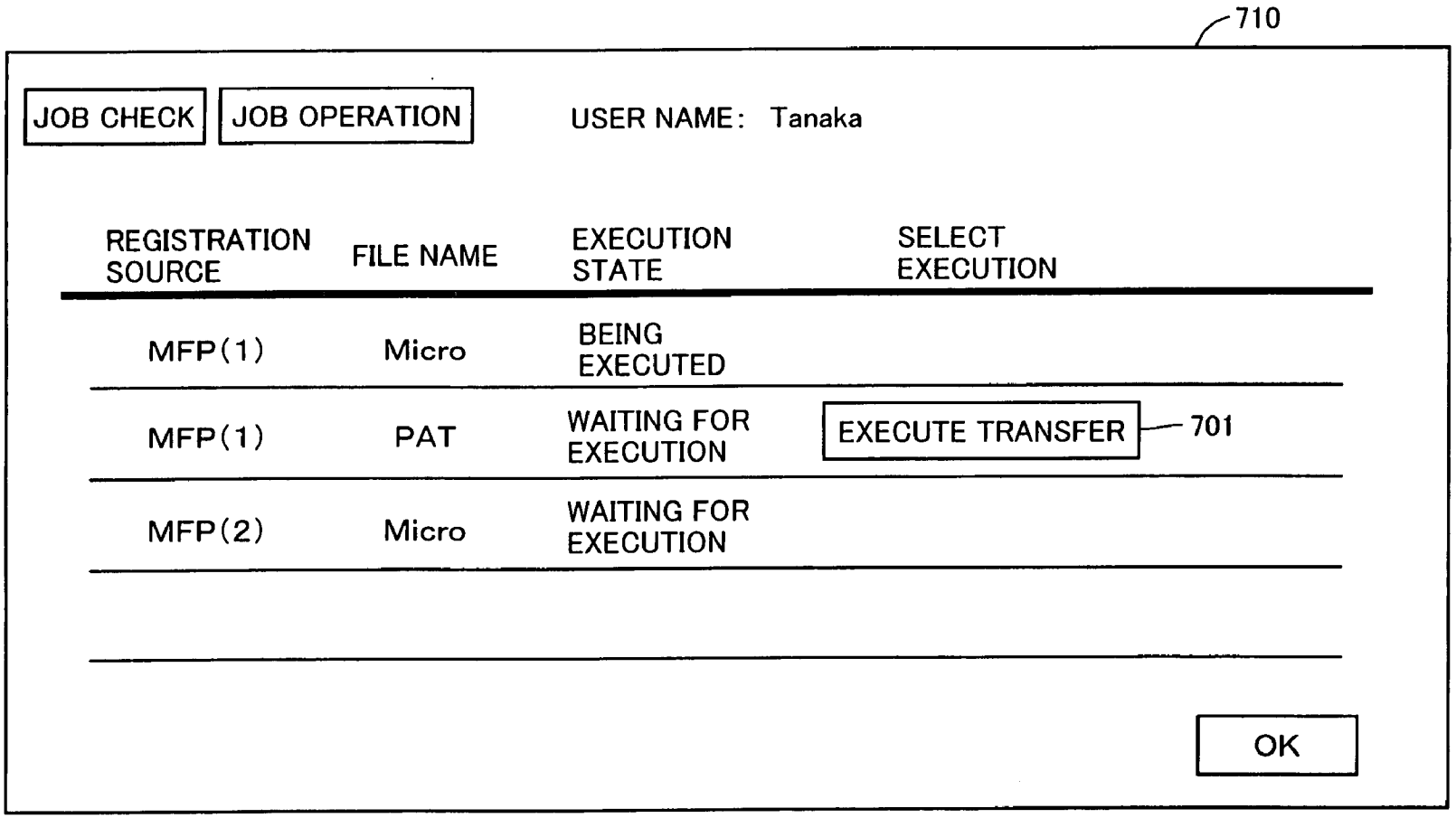
FIG. 19 shows another example of the job check picture displayed on the display screen of the MFP in FIG. 2.

Since the job is transferred, the job check picture is updated as illustrated in FIG. 19. Referring to FIG. 19, a job check picture 710 differs from job check picture 700 (see FIG. 16) in that the registration source of the third job changes to MFP (2), and the transfer execution key thereof is no longer displayed.

Referring to FIG. 14 again, when the job is received in step S1230 and the job management table is updated, CPU 101 determines in a step S1240 whether the MFP thereof can immediately execute the job or not. When it can immediately execute the job, CPU 101 advances the process to a step S1280. Otherwise, CPU 101 advances the process to a step S1250.

Figure 20:
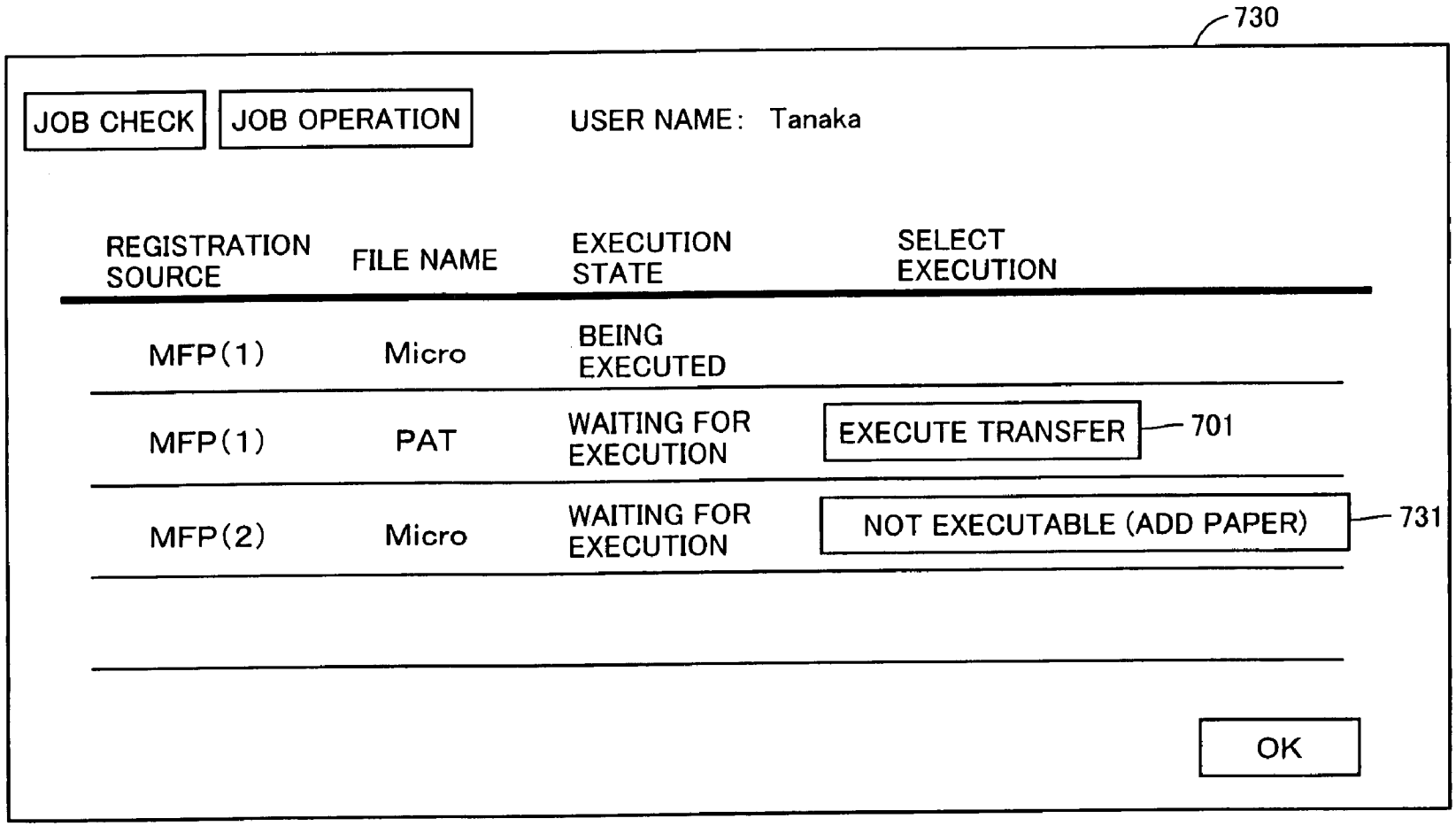
FIG. 20 shows still another example of the job check picture displayed on the display screen of the MFP in FIG. 2.

In step S1250, CPU 101 updates the job check picture to display an alarm to the effect that the job is not executable. FIG. 20 illustrates an example of the job check picture thus updated.

Referring to FIG. 20, a job check picture 730 differs from job check picture 710 (see FIG. 19) in that job check picture 730 represents in the field of "SELECT EXECUTION" of the third job to the effect that printing of the job is not executable, and paper must be added for the printing.

Figure 14:
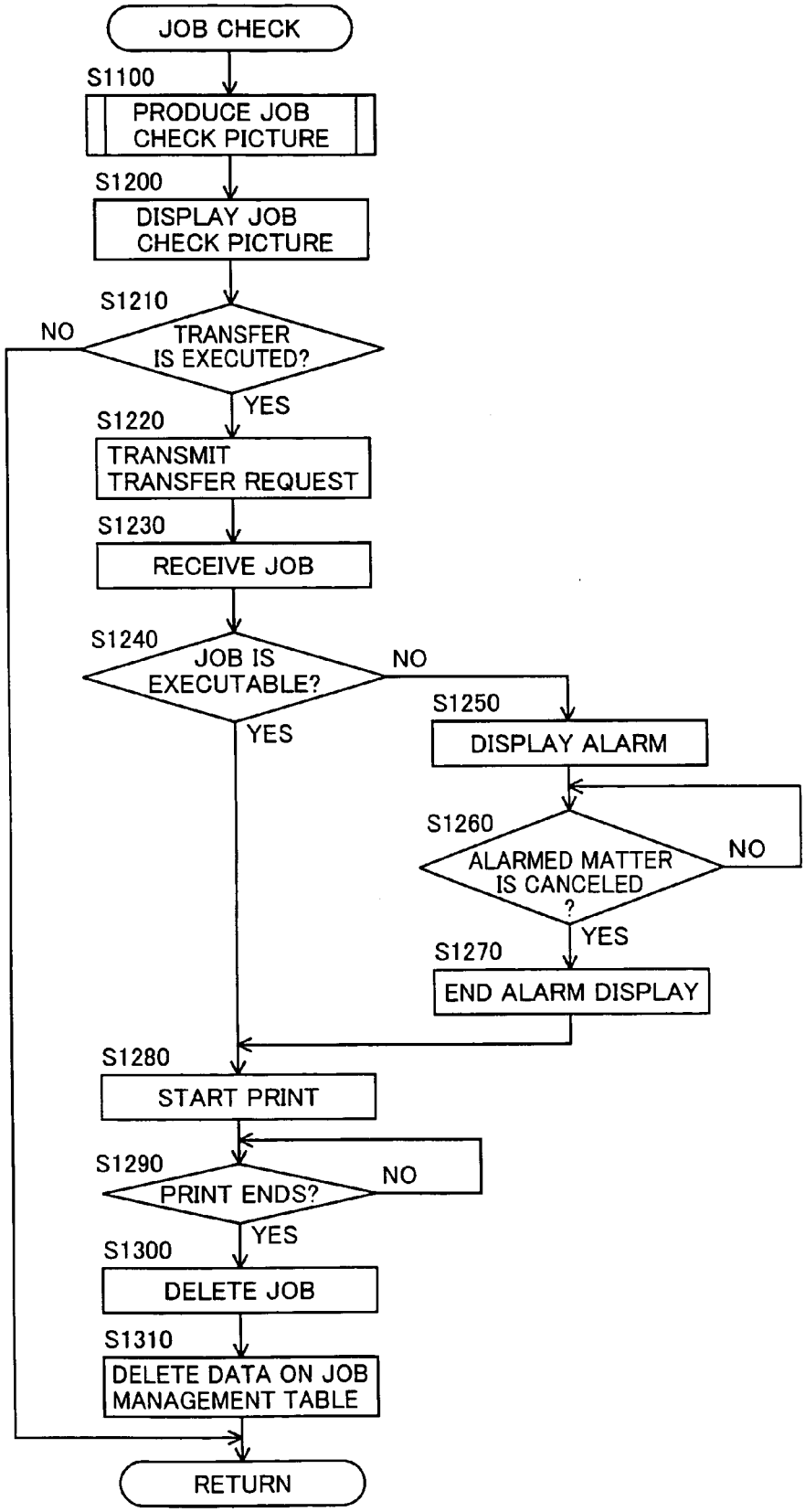
FIG. 14 is a flowchart of a subroutine of job check processing in FIG. 5.

Referring to FIG. 14, after the alarm is issued in step S1250, CPU 101 determines in a step S1260 whether the alarmed matter is canceled or not. When it is determined that the alarmed matter is canceled, the process proceeds to a step S1270.

In step S1270, CPU 101 terminates the alarm display, and advances the process to step S1280.

Figure 21:
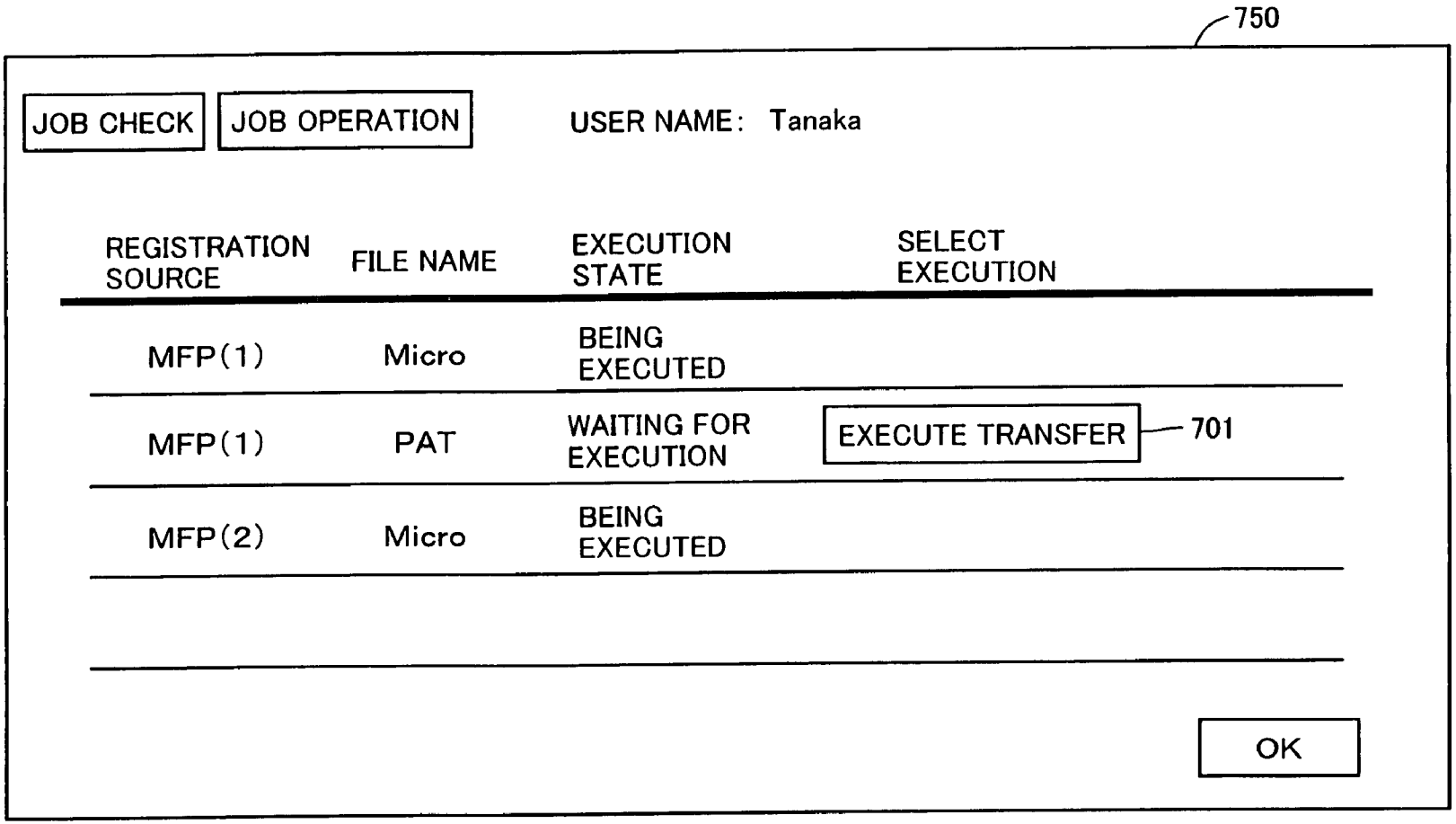
FIG. 21 shows yet another example of the job check picture displayed on the display screen of the MFP in FIG. 2.

In step S1280, CPU 101 starts the printing of the job received in step S1230, and advances the process to a step S1290. In step S1280, CPU 101 updates the execution state of the job, of which printing starts, in the job management table to "being executed". Thereby, display screen 111A displays a job check picture 750 shown in FIG. 21. In job check picture 750 shown in FIG. 21, the execution state of the third job is "BEING EXECUTED".

In step S1290, CPU 101 determines whether the printing of the job received in step S1230 terminated or not. When it terminated, the process proceeds to a step S1300.

In step S1300, CPU 101 deletes the data of the job already printed from memory 453, and advances the process to a step S1310.

In step S1310, CPU 101 deletes the data related to the job in question from the job management table, and returns the process to step S100 (FIG. 5).

In the image processing system of the embodiment described above, the user logs in to a certain MFP which is not printing the job, causes this MFP to display a list of the jobs which are already registered by the same user in other MFPs, selects the job from the list and transfers it to the MFP in question. The MFP at the destination prints the job transferred thereto.

Second Embodiment

An MFP, which is a second embodiment of the invention of the image processing apparatus of the invention, has the substantially same hardware structure as MFPs 100A and 100B of the first embodiment already described. The MFP of the second embodiment differs from the first embodiment in contents of the processing to be executed. The description will be given primarily on the difference.

Figure 22:
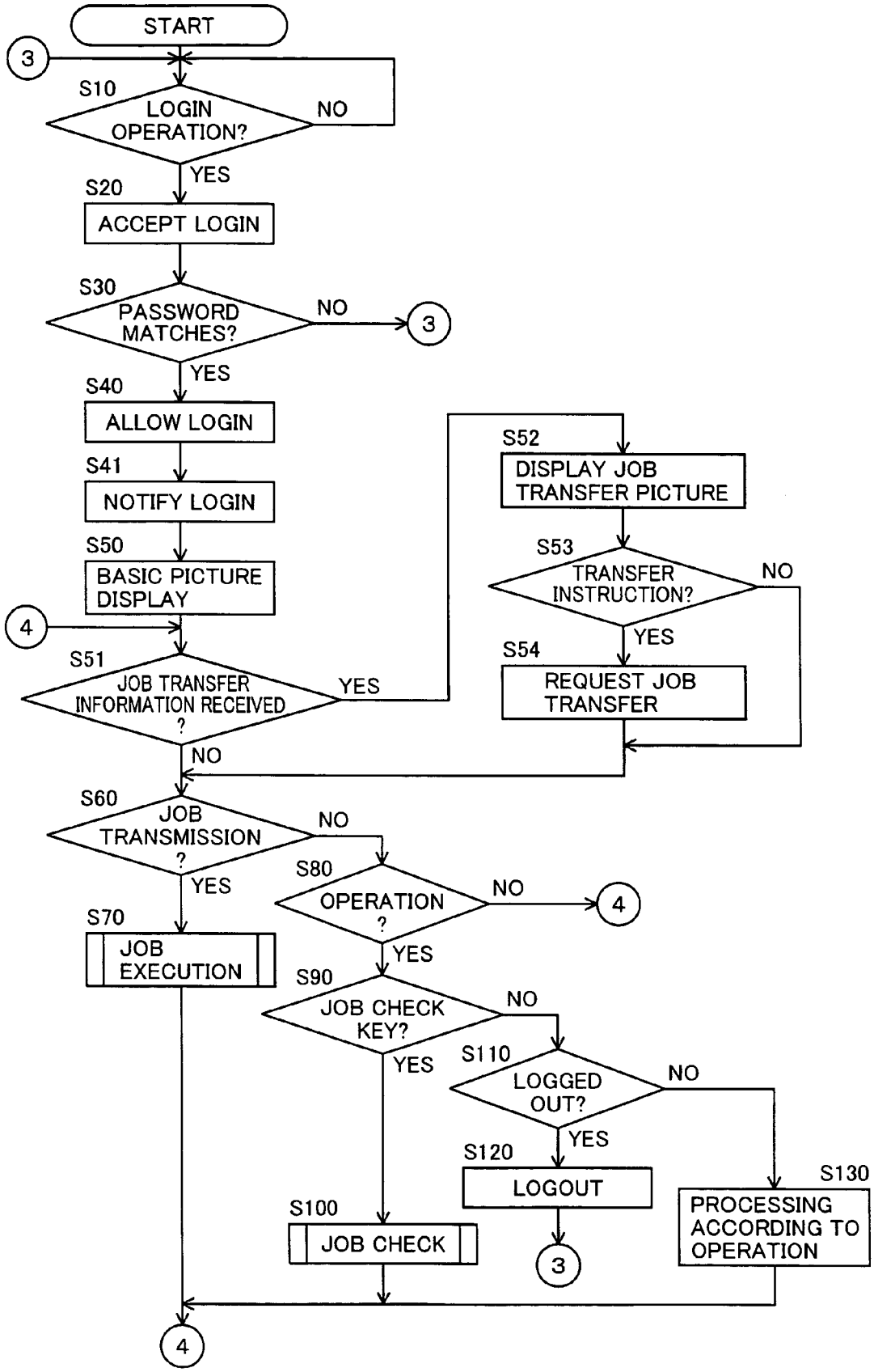
FIG. 22 is a flowchart of processing executed by a CPU of a MFP of a second embodiment of the invention after power-on and completion of initial setting of the MFP.

FIG. 22 illustrates processing to be executed by the MFP of this embodiment after the power-on and initial setting, and corresponds to a modification of the flowchart of FIG. 5.

Referring to FIG. 22, a CPU (which will be merely referred to as "CPU 101" hereinafter) of the MFP of this embodiment executes the processing in step S40 to allow logging in. In a subsequent step S41, CPU 101 provides a notification of allowance of the logging in together with the information specifying the allowed user to all the MFPs on the network. Thereby, all the MFPs on the network recognize the users logging in to the other MFPs as well as the times of such logging in.

CPU 101 displays the basic picture in step S50, and then advances the process to a step S51.

In step S51, CPU 101 determines whether it received the information for job transfer or not. The information for job transfer relates to jobs which are registered in the other MFPs by the login user of its own MFP. When it is determined that CPU 101 received the information for job transfer, it advances the process to a step S52. Otherwise, CPU 101 advances the process to a step S60.

The processing from step S60 to step S130 is substantially the same as that of the first embodiment, and therefore description thereof is not repeated.

Figure 23:
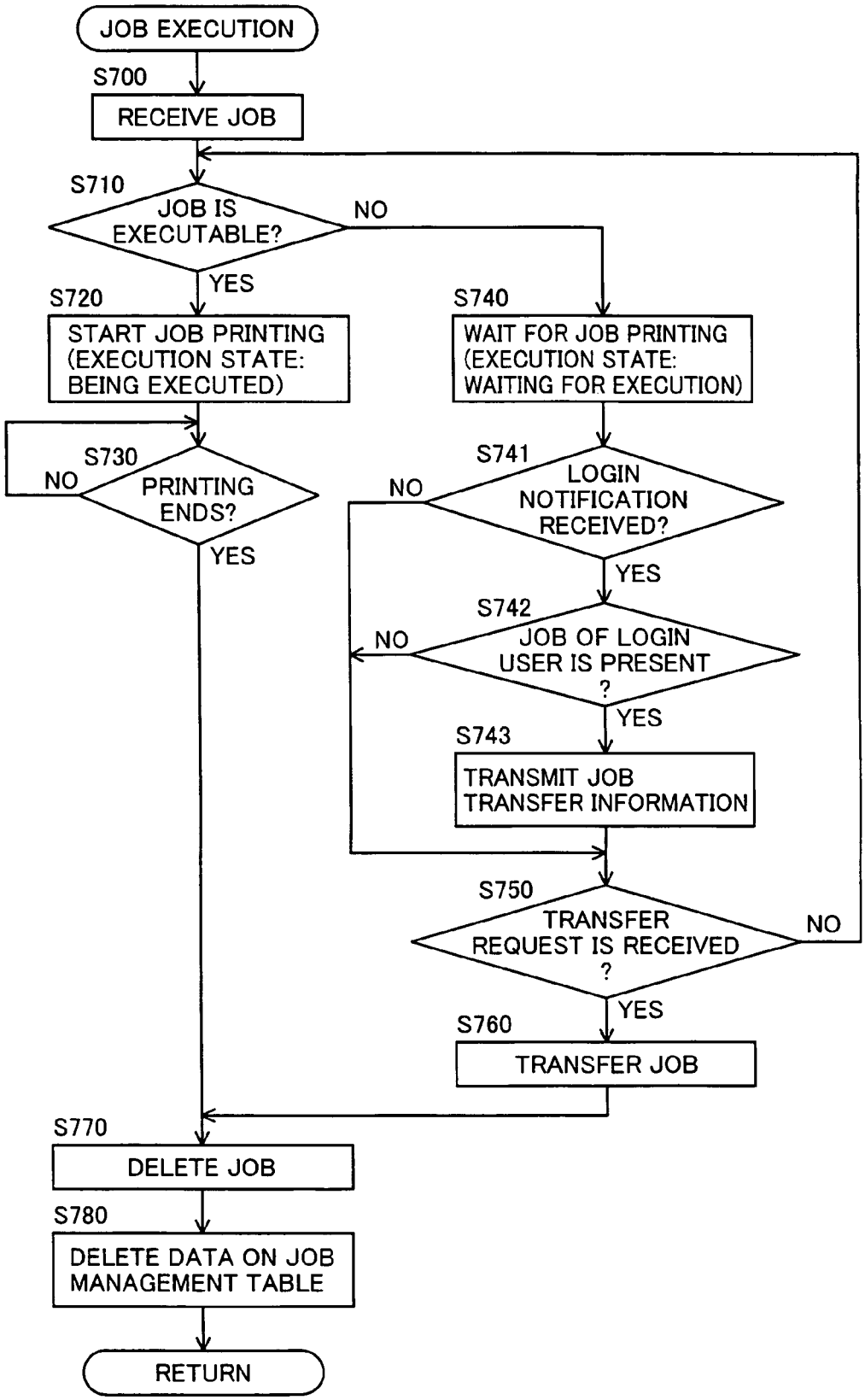
FIG. 23 is a flowchart of job execution processing executed by the CPU of the MFP of the second embodiment of the invention.

FIG. 23 is a flowchart of the job execution processing to be executed by CPU 101 of this embodiment, and corresponds to a modification of the flowchart of FIG. 10.

In this embodiment, CPU 101 waits for printing of the job in step S740, and then determines in a step S741 whether it receives a login notification from another MFP. The login notification, of which reception is determined, corresponds to the notification in step S41. When it is determined that the login notification is received, the process proceeds to a step S742. Otherwise, the process proceeds to step S750.

In step S742, CPU 101 determines whether the job of the login user included in the login notification is registered in the job management table of its MFP or not. When registered, CPU 101 advances the process to a step S743. Otherwise, it advances the process to step S750.

In step S743, CPU 101 transmits the job transfer information to the MFP which transmitted the login notification, and advances the process to step S750. CPU 101 searches the job management table of its own MFP to select the job of the user name which is the same as that of the user notified as the login user by the login notification, and produces the job transfer information formed of the information registered in connection with the selected job. CPU 101 may prepare the job transfer information formed of the information of only the job in the execution state of "waiting for execution".

In and after step S750, the processing indicated by the same steps as those in FIG. 10 is executed. Contents of such processing are the same as those already described with reference to FIG. 10, and therefore description thereof is not repeated.

The MFP of this embodiment transmits the job transfer information to a different MFP in step S743 when the user logs in to this different MFP, and the job transfer information is received by the processing in step S51. The job transfer information relates to the job which is registered by the user in the user's MFP when the user logs in to the different MFP.

Referring to FIG. 22 again, when it is determined in step S51 that the job transfer information is received, CPU 101 displays a job transfer picture on display screen 111A in step S52, and advances the process to a step S53.

Figure 24:
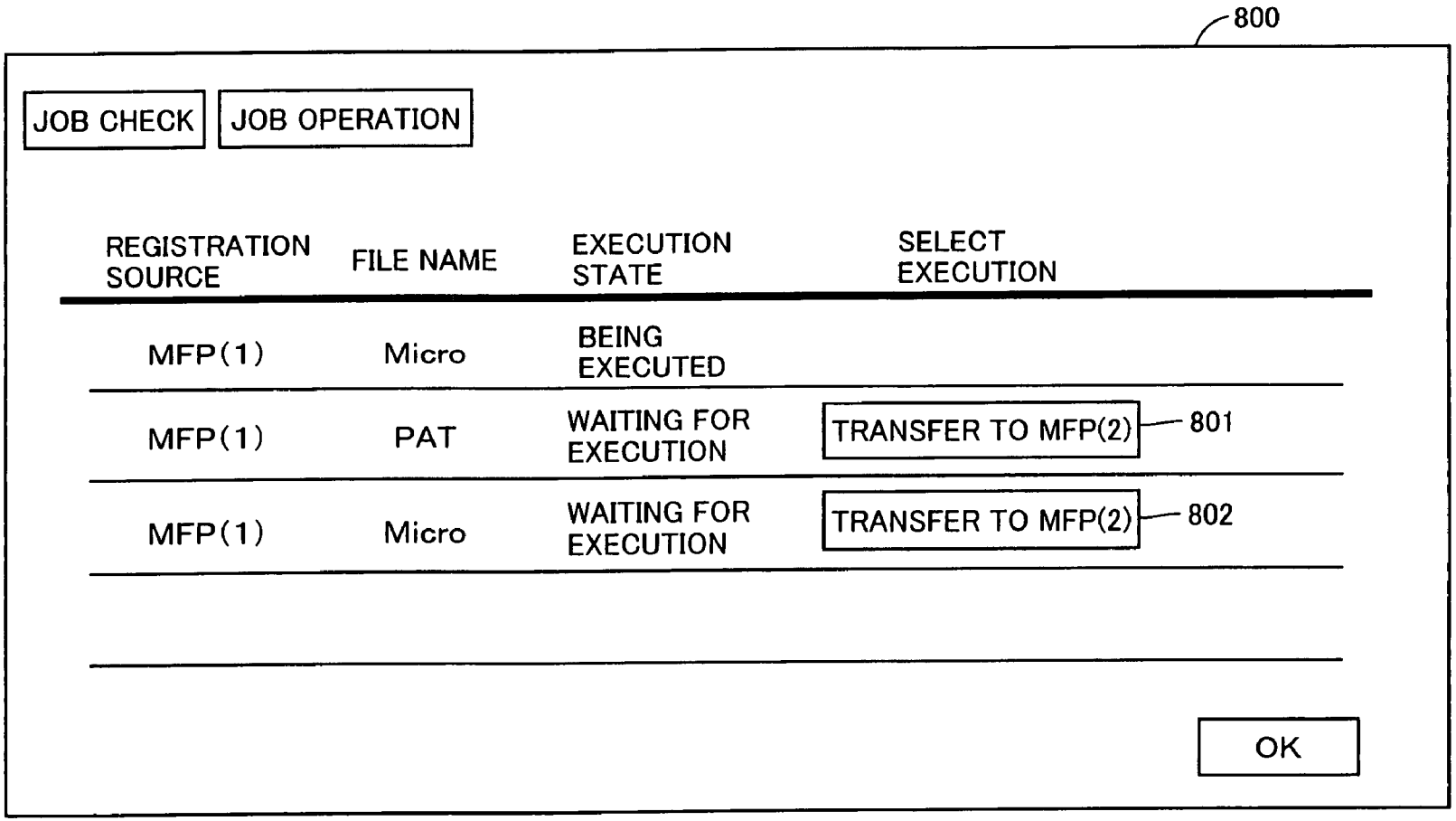
FIG. 24 shows an example of a job transfer picture displayed on a display screen of the MFP of the second embodiment of the invention.

FIG. 24 shows an example of the job transfer picture, which is produced based on the job transfer information.

A job transfer picture 800 represents a list of the jobs registered by a certain user in a certain MFP, and more specifically represents the user name as well as the registration source, file name and execution state of each job, similarly to the job check picture. CPU 101 causes job transfer picture 800 to represent transfer keys 801 and 802 for the respective jobs in the execution state represented as "WAITING FOR EXECUTION".

FIG. 24 shows job transfer picture 800 displayed by MFP (2). Job transfer picture 800 is displayed by the MFP(2) when the user, who has registered three jobs in MFP(1), logs in MFP(2) based on the fact that the MFP(1) receiving the notification of such login transmits the job transfer information for the three jobs in FIG. 24 to the MFP(2). "TRANSFER TO MFP(2)" is displayed on each of transfer keys 801 and 802 for the purpose of notifying the user of the fact that the job will be transferred to the MFP displayed on each of transfer keys 801 and 802 when transfer keys 801 or 802 is operated.

Referring to FIG. 22 again, CPU 101 determines in step S53 whether an operation instructing the transfer is performed or not. The operation of instructing the transfer is an operation effected on transfer key 801 or 802. When CPU 101 determines that the operation is performed, it advances the process to a step S54. Otherwise, it advances the process to a step S60.

In a step S54, CPU 101 requests the MFP, in which the job corresponding to the operated transfer key is registered, to transfer the job to its own MFP, and executes the printing of the job transferred thereto. Then, CPU 101 advances the process to a step S60.

According to the MFP of the embodiment described above, the user, who has already registered the job, logs in a different MFP on the network, and actively executes the processing for transferring the job registered in the MFP in question by transmitting the job transfer information to above different MFP of the login destination.

The image processing systems of the respective embodiments already described are configured such that the information (job management table) relating to the job registered in the MFP is transmitted only between the MFPs. However, the image processing system may be configured such that PCs 200A and 200B can also view the information relating to the job in each MFP, and can instruct the transfer of job between the MFPs.

In each of the embodiments already described, the print job has been described as an example of the job of processing the image. However, the job to be executed according to the invention may be other jobs such as transmission of a scanned image. Description will now be given by way of example on an operation performed by an image processing system in such a case that job is transmission of a scanned image.

For example, it is assumed that a plurality of transmission jobs handling many original documents are already registered in a certain MFP when the user register a transmission job in the same MFP. According to the invention, the user can log in to a different MFP to transfer the registered job to this different MFP, and can transmit the scanned image to the MFP receiving the transferred job.

The job may be execution of facsimile transmission.

The jobs to be executed according to the invention may be processing of input images. Specific operations of such jobs may be vertical inversion, inclination correction, inclination correction, color conversion, removal of offset, encryption and compression, and thus may be operations requiring a certain time for image processing. According to the invention, even when the above kinds of jobs were already registered in the MFP in which the user registered the job, the user can log in to a different MFP, and can execute the job by transferring the job thereto. Thus, even in the above case, the invention is effective.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. An image processing system having at least two image processing apparatuses connected by a network, each image processing apparatus, comprising:

a storing unit storing a job in a manner linked to information specifying a user;

an authentication unit accepting input of information specifying the user and authenticating a login of the user whether to be allowed or not by using the information specifying the user;

a notifying unit in a case where said authentication unit authenticates that the login of the user is allowed, notifying all of the different image processing apparatuses of the information specifying the authenticated user;

a user information receiving unit receiving the information specifying the authenticated user notified from the notifying unit of another image processing apparatus;

a job information transmitting unit, in a case where said user information receiving unit receives the information specifying said authenticated user and in a case where the job linked to the information specifying the user is stored in said storing unit, transmitting the information related to the job to the image processing apparatus providing a notification of the information specifying said authenticated user;

a job information receiving unit receiving the information relating to the job linked to the user authenticated in said authenticating unit from the job information transmitting unit of the different image processing apparatus;

a selecting unit, in a case where said job information receiving unit receives the information relating to the job linked to said authenticated user, displaying the information for specifying the job linked to the authenticated user based on the information related to the job and accepting selection of the job;

a requesting unit transmitting a transfer request for the selected job to the different image processing apparatus storing the job linked to said authenticated user selected in said selecting unit;

a transfer request receiving unit receiving the transfer request for the job linked to said authenticated user stored in said storing unit that is transmitted from the requesting unit of the different image processing apparatus;

a job transfer unit, in a case where said transfer request receiving unit receives the transfer request for the job linked to said authenticated user, transferring a requested job to the image processing apparatus transmitting the transfer request for the job linked to said authenticated user, the image processing apparatus providing the notification of the information specifying said authenticated user; and an obtaining unit obtaining the job linked to said authenticated user that is transferred from the job transfer unit of the different image processing apparatus.

2. The image processing system according to claim 1, wherein said job storing unit stores the job in a manner linked to the user and an execution state of said job, and said job transfer unit transfers the job in an execution state of waiting for execution to said image processing apparatus transmitting the transfer request for the job linked to said authenticated user.

3. The image processing system according to claim 2, wherein said job information transmitting unit transmits the information related to the job waiting for execution.

4. An image processing apparatus for executing a job of processing an image, the apparatus comprising:

a job storing unit storing a job in a manner linked to information specifying a user;

a user information receiving unit receiving information specifying an authenticated user notified from a different image processing apparatus;

a job information transmitting unit, in a case where said user information receiving unit receives the information specifying said authenticated user and in a case where the job linked to the information specifying the user is stored in said storing unit, transmitting the information related to the job to the image processing apparatus providing a notification of the information specifying said authenticated user;

a transfer request receiving unit receiving a transfer request for the job linked to said authenticated user stored in said storing unit that is transmitted from the different image processing apparatus; and a job transfer unit, in a case where said transfer request receiving unit receives a transfer request for the job linked to said authenticated user, transferring a requested job to the image processing apparatus transmitting the transfer request for the job linked to said authenticated user, the image processing apparatus providing the notification of the information specifying said authenticated user.

5. The image processing apparatus according to claim 4, wherein said job storing unit stores the job in a manner linked to the user and an execution state of said job, and said job transfer unit transfers the job in an execution state of waiting for execution to the image processing apparatus transmitting the transfer request for the job linked to said authenticated user.

6. The image processing apparatus according to claim 5, wherein said job information transmitting unit transmits the information related to the job waiting for execution.

7. An image processing apparatus for executing a job of processing an image, the apparatus comprising:

an authentication unit accepting input of information specifying a user and authenticating a login of the user whether to be allowed or not by using the information specifying the user;

a notifying unit, in a case where said authentication unit authenticates that the login of the user is allowed, notifying all of different image processing apparatuses of the information specifying the authenticated user;

a job information receiving unit receiving the information related to the job linked to the user authenticated in said authentication unit from a different image processing apparatus;

a selecting unit, in a case where said job information receiving unit receives the information related to the job linked to said authenticated user, displaying the information for specifying the job linked to the authenticated user based on the information related to the job and accepting selection of the job;

a requesting unit transmitting a transfer request for the selected job to the different image processing apparatus storing the job linked to said authenticated user selected in said selecting unit; and an obtaining unit obtaining the job linked to said authenticated user that is transferred from the different image processing apparatus.

8. A computer-readable storage medium storing a computer executable control program of an image processing apparatus for executing a job of processing an image, wherein said control program causes said image processing apparatus to execute the steps of:

storing a job in a manner linked to information specifying a user;

receiving information specifying an authenticated user notified from a different image processing apparatus;

transmitting the information related to the job to the image processing apparatus providing a notification of the information specifying said authenticated user, in a case where said image processing apparatus receives the information specifying said authenticated user and in a case where the job linked to the information specifying the user is stored in said image processing apparatus;

receiving a transfer request for the job linked to said authenticated user stored in said image processing apparatus that is transmitted from the different image processing apparatus; and transferring a requested job to the image processing apparatus transmitting the transfer request for the job linked to said authenticated user, the image processing apparatus providing the notification of the information specifying said authenticated user, in a case where said image processing apparatus receives the transfer request for the job linked to said authenticated user.

9. A computer-readable storage medium storing a computer executable control program of an image processing apparatus for executing a job of processing an image, wherein said control program causes said image processing apparatus to execute the steps of:

accepting input of information specifying a user and authenticating a login of the user whether to be allowed or not by using the information specifying the user;

notifying all of different image processing apparatuses of the information specifying the authenticated user, in a case where said image processing apparatus authenticated that the login of the user is allowed;

receiving the information related to the job linked to said authenticated user from a different image processing apparatus;

displaying the information for specifying the job linked to said authenticated user based on the information related to the job, in a case where said image processing apparatus receives the information related to the job linked to said authenticated user;

accepting selection of the job of which information is displayed;

transmitting a transfer request for the selected job to the different image processing apparatus storing the selected job linked to said authenticated user; and obtaining the selected job linked to said authenticated user that is transferred from the different image processing apparatus.

10. A method of controlling an image processing apparatus performed in an image processing system having at least two image processing apparatuses connected over a network, comprising:

in one image processing apparatus of said two image processing apparatuses:

accepting input of information specifying a user and authenticating a login of the user whether to be allowed or not by using the information specifying the user;

in a case where it is authenticated that the login of the user is allowed, notifying all of different image processing apparatuses of the information specifying the authenticated user;

receiving the information related to the job linked to said authenticated user from the different image processing apparatus;

displaying the information for specifying the job linked to the authenticated user based on said received information related to the job and accepting selection of the job;

transmitting to the different image processing apparatus a transfer request for the job that the selection is accepted; and obtaining from the different image processing apparatus the job that the transfer request is transmitted, further comprising:

in said different image processing apparatus:

storing the job in a manner linked to the information specifying the user;

receiving the information specifying said authenticated user notified from said one image processing apparatus;

in a case where the job linked to the received information specifying the user is stored, transmitting the information related to the job to said one image processing apparatus;

receiving the transfer request for the stored job linked to said authenticated user; and in a case where the transfer request for the job linked to said authenticated user is received, transferring a requested job to said one image processing apparatus.

11. The method of controlling the image processing apparatus according to claim 10, further comprising:

in said different image processing apparatus:

storing the job in such a manner that the information specifying the user and an execution state of said job are related to each other; and transferring the job in an execution state of waiting for execution to said one image processing apparatus.

12. The method of controlling the image processing apparatus according to claim 10, further comprising:

in said different image processing apparatus:

transmitting to said one image processing apparatus the information related to the job in the execution state of waiting for execution.

* * * * *